US005613823A

United States Patent [19]

Bayne

[11] Patent Number: 5,613,823

[45] Date of Patent: Mar. 25, 1997

[54] RESIDENTIAL REFUSE COLLECTION CART LIFTER WITH UNIVERSAL FEATURES

[75] Inventor: Jimmy O. Bayne, Simpsonville, S.C.

[73] Assignee: Bayne Machine Works, Inc., Simpsonville, S.C.

[21] Appl. No.: 458,509

[22] Filed: Jun. 2, 1995

Related U.S. Application Data

[62] Division of Ser. No. 167,235, Dec. 14, 1993, Pat. No. 5,503,512, which is a division of Ser. No. 903,078, Jun. 22, 1992, Pat. No. 5,308,211.

[51] Int. Cl.[6] ..... B65F 3/02

[52] U.S. Cl. ..... 414/408; 414/404; 414/406

[58] Field of Search ..... 414/303, 404, 414/406, 408, 409, 419, 420, 421, 425

[56] References Cited

U.S. PATENT DOCUMENTS

| | | | |
|---|---|---|---|
| 3,738,516 | 6/1973 | Wells . | |
| 3,804,277 | 4/1974 | Brown et al. . | |
| 3,894,642 | 7/1975 | Shive . | |
| 3,931,901 | 1/1976 | Jones . | |
| 4,365,922 | 12/1982 | Borders | 414/406 |
| 4,422,814 | 12/1983 | Borders | 414/303 |
| 4,479,751 | 10/1984 | Wyman et al. | 414/406 |
| 4,613,271 | 9/1986 | Naab | 414/303 |
| 4,687,405 | 8/1987 | Olney | 414/408 |
| 4,699,557 | 10/1987 | Barnes | 414/408 |
| 4,773,812 | 9/1988 | Bayne et al. | 414/408 |

*Primary Examiner*—David A. Bucci
*Assistant Examiner*—Stephen Gordon
*Attorney, Agent, or Firm*—Dority & Manning, P.A.

[57] ABSTRACT

A lifter picks up different style residential refuse collection carts, without requiring operator adjustments. An upper movable clamp bar with adjustable closure timing cooperates with a finger support bar to grab a cart type having a single upper lifting lip and otherwise smooth sides. A hinged saddle and hinged sliding hook lift carts having a pair of opposing engagement surfaces such as lift bars. The hinged members are automatically pivoted into retracted positions during presentation of the smooth sided style cart, but are otherwise maintained in place for engaging carts of the other type. The lifter has a relatively short face plate for size and weight advantages, made possible by alternate downward extension and subsequent retraction of the hinged sliding hook during a lift cycle. Rollers on the extending portion of the face plate prevent cart scarring. Adjustment for different height carts is provided by a vertical lift assembly which uses a hydraulic sequencing valve to first raise the lifter to an appropriate height for engaging the cart and then to cycle through a dumping process. The combination of compact lifter thickness and length enhances lifter usage with front load box truck arrangements or with rear or side truck locations.

12 Claims, 14 Drawing Sheets

RESIDENTIAL REFUSE COLLECTION CART LIFTER WITH UNIVERSAL FEATURES

This is a division of application Ser. No. 08/167,235, now U.S. Pat. No. 5,503,512 and filed Dec. 14, 1993, which is a division of Ser. No. 07/903,078, filed Jun. 22, 1992, now U.S. Pat. No. 5,308,211.

BACKGROUND OF THE INVENTION

The present invention concerns in general improved receptacle dumping apparatus and in particular concerns lifter technology with universally adaptive features for use with residential refuse collection carts of different types.

Technology related to residential refuse collection (and other service areas) has advanced in the last several decades generally from the use of metal trash cans which were manually lifted and dumped to the use of receptacles with wheels which are rolled by the resident down a driveway or the like to a curb location at which the receptacle is lifted and dumped by a particular lifting apparatus. One example of such a lifting apparatus for lifting and dumping rollable receptacles is disclosed in Bayne et al. (U.S. Pat. No. 4,773,812) issued Sep. 27, 1988, and Reexamination Certificate issued on Apr. 16, 1991.

As the number of designers competing in the newer technology rolling carts and cart lifters increased, different styles of carts emerged together with specialized lifters for handling a specific cart type.

One cart type which became prominent includes two opposing engagement members located respectively near the top and middle of the cart and which are grasped for lifting and dumping of the cart. Operation of a lifting element below the upper cart engagement member permits the cart to be lifted while operation of another engaging element in the opposite direction and directed at the lower cart engagement member permits the cart to be retained on a carriage as the cart is raised and inverted during dumping. Such cart style is in the industry sometimes referred to as a bar lift cart or U.S. or "Domestic" style cart.

The following patents all provide examples of such domestic cart style and typically hydraulically actuated lifting devices for raising and inverting such carts for dumping the contents thereof into a further receptacle such as a refuse collection vehicle or a relatively larger collection box. See for example the cart 10 of FIG. 7 of Shive (U.S. Pat. No. 3,894,642), as well as the carts and corresponding lifters therefor as utilized in Borders (U.S. Pat. Nos. 4,422,814 and 4,365,922), and Brown et al. (U.S. Pat. No. 3,804,277). In general, such patents disclose various mechanisms for controllably manipulating a lower engagement member of the lifter in a generally downward direction for engaging the relative top side of a lower engagement bar of the cart to be emptied. Each of the patents are commonly assigned to Rubbermaid Corporation of Statesville, N.C., or its successor Applied Products, Inc., of Statesville, N.C., now. Toter, Inc., of Statesville, N.C., a manufacturer or distributor of roll-out carts and cart lifters.

An alternate version of the "Domestic" style cart is represented by refuse container 12 of FIG. 1 of Wyman et al. (U.S. Pat. No. 4,479,751). In such patent, the receptacle itself has two separate bars which are again engaged by respective upper and lower lifter engagement members. The lower lifter engagement member is again pivoted in a relatively downward direction for engaging the relatively upper most surface of the lower cart bar. A second bar is substituted in the upper position in place of the molded engagement region or moldably encased bar of the above-referenced Toter, Inc., patent designs.

Other examples of lifter mechanisms designed for use with specific (and rollable) refuse containers are disclosed by Jones (U.S. Pat. No. 3,931,901) and Wells (U.S. Pat. No. 3,738,516).

Another style of roll-out cart which has become relatively prominent is known as a "European" style cart. Such a cart has generally smooth sides (i.e., does not have external bars or their equivalents along a side thereof, but has instead a molded upper lip which is adequately rein-forced and sized for being adequately clamped for lifting and dumping of the "European" style cart by engagement at such single engagement member or point. An example of such a "European" style cart is represented by cart 50 of FIG. 3 of Naab (U.S. Pat. No. 4,613,271).

Generally speaking, the same lifter mechanism features (i.e., engagement members) cannot be used for engaging and lifting different cart styles, particularly as between the above-described "Domestic" and "European" cart styles and related variations. Therefore, most cart lifters have heretofore been of a dedicated design, that is, structured for use with either the European style cart or the domestic style cart, but not both. At the same time, the increase of companies competing for residential trash pickup in a single neighborhood, and due to other factors, has resulted in mixed varieties or styles of carts on a single trash pickup route. Such situation necessitates that the refuse collection vehicle be somehow equipped for handling (i.e., lifting and dumping) the different cart styles which will likely be encounted during a typical trash collection run.

While refuse collection vehicle styles have varied in recent years, just as has the technology described above (such as rear load, side load, and front load vehicles), only several lifter units can be ordinarily outfitted onto a refuse collection vehicle at a given time. Therefore, an entire truck or refuse collection vehicle becomes in a sense dedicated to a particular cart style just as does the design of the lifter. Since refuse collection vehicles can cost as much as One Hundred Fifty Thousand Dollars ($150,000), requiring duplication of vehicles simply in order to handle different cart styles which may-be encountered can be a very expensive approach to a widespread problem.

The above-referenced U.S. Pat. No. 4,613,271 to Naab seeks to address one aspect of such problems by providing a device which is capable of emptying different style garbage containers. Such arrangement involves providing on a single unit both a clamping mechanism for grasping a molded upper lip of European style carts and opposing engagement members for engaging paired lift engagement members of a domestic style cart. See cart 50 of FIG. 3 and cart 55 of FIG. 4, respectively, of the Naab patent. Naab uses a gravity or spring system in conjunction with an upper gripper 37 to permit the gripper to be pivoted out of the way for operation of a clamp mechanism whenever a European style cart is presented. At the same time, Naab provides a lower cart engagement member which is pivoted generally in the same direction as the above-described prior art arrangements for lifting domestic style carts. In other words, the lower engagement member of Naab is pivoted upwardly into a retracted position during dumping of European style carts, but pivoted downwardly into a extended position against the relatively uppermost side of the lower lift engagement member of a cart whenever a domestic style cart is being dumped.

The Naab arrangement utilizes a spring 45 for biasing a locking hook 44 into an upwardly pivoted or retracted position. Naab then uses various arrangements for overcoming such biasing and positively moving locking hook 44 outward and downward into engagement with a lower lift bar whenever a domestic style cart is being dumped.

In some embodiments, Naab uses a specific turn-on/turn-off device keyed by a switch actuator 67 which itself is actuated by contact from gripper 37. Electric, hydraulic valve, or mechanical means may be associated with such switch actuator 67 for changing the position of an adjustable settable sleeve. Naab FIG. 8 illustrates an electromagnetic switchable version while Naab FIG. 9 illustrates a fluid power (e.g., hydraulic) arrangement.

In some embodiments, such as that shown in FIGS. 12 through 15, Naab uses a counterlocking device for placement of the locking hook depending on the movement of other members (for example, gravity arm 87) during operation of the lift.

With respect to relative size considerations, the thickness of the overall Naab lift (i.e., the distance between where it is supported and the point at which a cart is engaged to be picked up) must necessarily accommodate the different mechanisms by which the Naab device functions in order to advance locking hook 44 outward and downward towards a lower lift bar. Such arrangement therefore serves as one limitation to minimizing such lifter thickness.

Another aspect of Naab is that the top clamp 35 of Naab for clamping European style carts is in a relatively fixed position and the cart molded lip is brought into contact with the lower side of element 35, as a carrying element 33 is positively moved upward from beneath the cart lip. Such an arrangement encompasses a certain minimum required mechanical operations, which again necessitates a certain thickness for the Naab lifter.

In addition to the strong need and desire for an efficient lifter which has universal features for lifting carts of different styles (i.e., domestic or European style carts), it is also a fact that carts of different sizes, and hence often times of different heights, are encountered on a residential refuse collection run, not to mention the variety encountered in other settings. The need arises to match the physical characteristics of a lifter with the size of the container to be dumped. If the initial engagement feature of the lifter is below the uppermost engagement feature of the cart, potentially dangerous operations can ensue since the lifter might be actuated into a partially raised and/or partially inverted position before the cart is properly or fully (i.e., safely) engaged. On the other hand, if the uppermost engagement feature of the lifter is above the uppermost engagement feature of the cart, then the cart must somehow be lifted upwardly until engagement is made, which may be literally impossible to do manually whenever carts have loads therein upwards of 200 pounds. At the very least, repeated such manual operations can give rise to physical stresses and injuries of operators.

The entire disclosures of the U.S. patents noted above are herewith incorporated by reference into the subject disclosure.

SUMMARY OF THE INVENTION

The present invention recognizes and addresses various of the foregoing problems, and others, concerning receptacle dumping apparatus and their operations. Thus, broadly speaking, a principal object of this invention is to provide improved receptacle dumping apparatus. More particularly, a main concern is improved cart lifters for use with different style residential refuse collection carts.

It is another particular object of the present invention to provide receptacle dumping apparatus which automatically adjust to different height containers to be lifted and dumped, while also automatically adapting to different style carts (i.e., different arrangements for lift engagement features).

Still another present object is to provide an apparatus which facilitates different placements of such improved lifting apparatus on refuse collection vehicles (such as at rear, side, or front end box positions) or which provides for improved usage in conjunction with relatively larger container boxes into which roll-out receptacles are to be dumped. It is a more particular object to provide such an improved apparatus which likewise further accommodates secondary dumping steps of the relatively larger container box, by being of adequately small size and weight to be processed through the dumping cycle (i.e., carried on the larger container box as it is dumped).

Still a further more particular object is to provide improved apparatus which renders more efficient various refuse collection vehicle operations, including eliminating certain manpower requirements while also increasing relative safety. At the same time, it is desired to make more efficient residential refuse collection operations by reducing the time involved for various dumping cycles, especially when including the overall operator time.

It is a still further present object to provide improved refuse collection vehicle usage, so that the same vehicle may be utilized for either residential or commercial collection routes.

Still further, a present object is to provide such an improved apparatus which is also of relatively reduced size (without reduced capacity) so as to broaden applications of such lifter (i.e., make same usable more efficiently and in more situations than prior lifters). At the same time, it is desired to make such an improved lifting apparatus which is relatively lighter than prior units, while also being more compact.

Additional objects and advantages of the invention are set forth in, or will be apparent to those of ordinary skill in the art from, the detailed description as follows. Also, it should be further appreciated that modifications and variations to the specifically illustrated and discussed features and materials hereof may be practiced in various embodiments and uses of this invention without departing from the spirit and scope thereof, by virtue of present reference thereto. Such variations may include, but are not limited to, substitution of equivalent means, features, and materials for those shown or discussed, and the functional or positional reversal of various parts, features, or the like.

Still further, it is to be understood that different embodiments, as well as different presently preferred embodiments, of this invention, may include various combinations or configurations of presently disclosed features, elements, or their equivalents (including combinations of features or configurations thereof not expressly shown in the figures or stated in the detailed description). One exemplary such embodiment of the present invention relates to a lifting apparatus for use with different style residential refuse collection carts, for lifting and dumping the contents thereof into a larger refuse container. Such apparatus comprises a lift plate for receipt thereon of a refuse collection cart to be emptied; drive means for moving the lift plate with a refuse collection cart received thereon so as to lift and dump the contents of such cart; cart clamping means associated with the lift plate for clamping thereon a refuse collection cart of the type having a single upper lip to be clamped during lifting of such cart; and cart latching means associated with the lift plate for latching thereon a refuse collection cart of the type having a pair of opposing latch engagement surfaces.

Such cart latching means preferably comprises a lower latch member movably mounted between an extended position thereof for engaging the lower of the cart latch engagement surfaces and a retracted position thereof pivoted relatively downward from the extended position thereof, and comprises an upper latch member movably mounted between an extended position thereof for engaging the upper of the cart latch engagement surfaces and a retracted position thereof pivoted relatively upward from the extended position thereof, such lower and upper latch members being biased into the respective extended positions for engagement with and lifting of a cart of the type having a pair of opposing latch surfaces, and further being respectively displaceable therefrom into their respective retracted positions upon contact with a cart of the type having a single upper lip to be clamped for engagement of such cart by the cart clamping means and for subsequent lifting thereof with the apparatus.

Another present exemplary embodiment concerns a receptacle dumping apparatus having a relatively shortened face plate area whenever in a lowered position thereof, such apparatus comprising a main face plate for receiving thereon a receptacle to be dumped, the main face plate being movable between a lowered upright position thereof for receipt of a receptacle and a raised inverted position thereof for dumping the contents of a received receptacle; drive means for controllably moving the main face plate between the respective lowered and raised positions thereof; at least one receptacle engaging member associated with the main face plate for receiving a receptacle thereon; face plate extension means operative during operation of the drive means for moving a face plate extension member between respective retracted and extended positions thereof relative to a lower edge of the main face plate in correspondence with respective lowered and raised positions thereof; and roller means carried on the face plate extension member for rotatably engaging a lower portion of a receptacle to be dumped as such receptacle is being raised, for stable lifting of such receptacle even with a relatively shortened face plate area whenever the main face plate is lowered and the face plate extension member is retracted.

Yet another construction comprising a present exemplary embodiment includes a lifting apparatus for use with different style residential refuse collection carts, for lifting and dumping the contents thereof into a larger refuse container, such apparatus comprising a lift plate for receipt thereon of a refuse collection cart to be emptied; drive means for moving the lift plate with a refuse collection cart received thereon so as to lift and dump the contents of such cart; cart latching means associated with the lift plate for latching thereon a refuse collection cart of the type having a pair of opposing latch engagement surfaces; cart clamping means associated with the lift plate for clamping thereon a refuse collection cart of the type having a single upper lip to be clamped during lifting of such cart, the cart clamping means comprising a lower clamping member relatively fixedly carried on the lift plate for engaging a relatively lower side of such a cart single lip as the drive means moves the lift plate for lifting such cart, and comprising an upper clamping member supported in relatively movable relationship to the lift plate for engaging a relatively upper side of the cart single lip; and clamp actuation means for closing the relatively movable upper clamping member towards the relatively fixed lower clamping member as the drive means operates, so that the single lip of the cart to be lifted is clamped by the upper and lower clamping members at a relatively earlier point in time during operation of the drive means, whenever such a cart type is being emptied.

Still another present lifting apparatus comprising an exemplary embodiment of this invention is for use with different size residential refuse collection carts, for lifting and dumping the contents thereof into a larger refuse container, such apparatus comprising a lift plate for receipt thereon of a refuse collection cart to be emptied; drive means for controllably moving the lift plate with a refuse collection cart received thereon so as to lift and dump the contents of such cart; cart engagement means associated with the lift plate for engaging a cart to be emptied for movement thereof with the lift plate; vertical adjustment means for relatively vertically shifting the position of the lift plate, drive means, and cart engagement means, between an initial null position thereof and a variable raised engaging position thereof at which the cart engagement means is positioned for engaging at least one predetermined lift engagement member on a cart to be emptied; and cycle control means associated with the vertical adjustment means and the drive means for first variably operating the vertical adjustment means so as to engage the cart engagement means with at least one lift engagement member of a given cart to be emptied, the height of which engagement member is not specifically known, and for automatically thereafter operating the drive means So as to lift and dump the contents of such engaged cart.

Still a further combination cart lifter in accordance with this invention for automatically engaging and lifting residential refuse collection carts of different styles having either one or two lift pickup points comprises particular features in accordance with this invention, including in combination specific support frame features, drive means, a main lift carriage including a generally planar member movable between a lowered upright position and a generally raised inverted position thereof, a pair of torque arms, a pair of idler arms, a first support bar and clamp bar assembly including a clamp bar pivotably mounted on the main lift carriage and clamp bar actuation means responsive to operation of the drive means for closing such clamp bar, a lift saddle pivotably mounted on the main lift carriage, a slider latch assembly including a carriage extension member received adjacent the main lift carriage base portion and carriage extension member actuation means responsive to operation of the drive means for relatively moving the carriage extension member, and a lift hook pivotably mounted on a distal end of the carriage extension member.

With such an arrangement of a present exemplary cart lifter, the first support bar and clamp bar assembly are automatically used for lifting cart styles having one pickup point while the lift saddle and lift hook are pivoted into their respective retracted positions, but automatically using the lift saddle and lift hook resiliently biased into their engaging positions for lifting cart styles having two respective upper and lower pickup points.

Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

Figure 1:
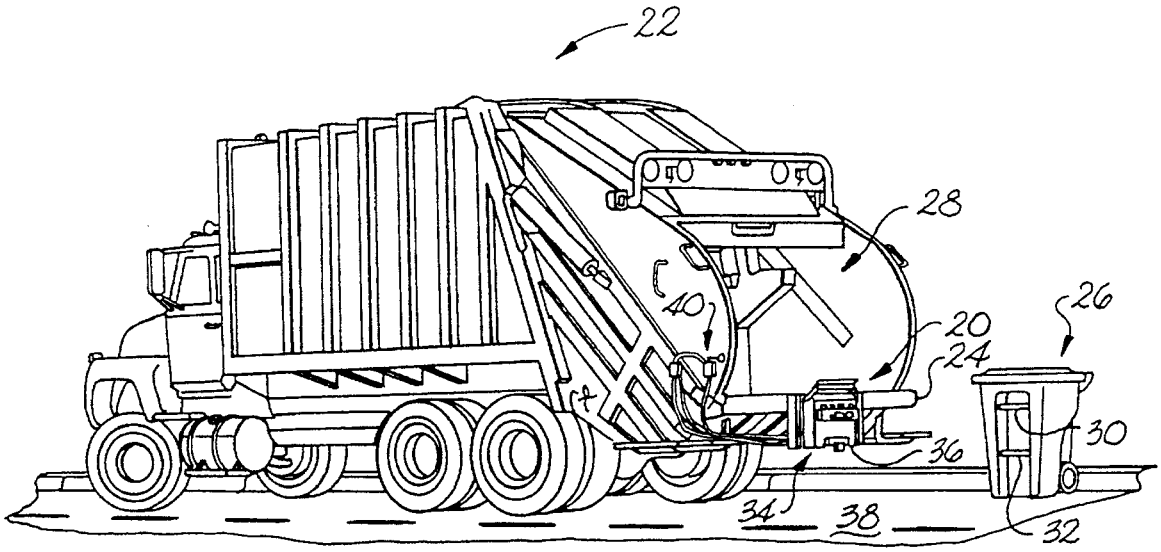
FIG. 1 is a perspective view of an exemplary rear load refuse collection truck shown in combination with an exemplary lifter in accordance with the subject invention and one exemplary style of a conventional cart for residential refuse collection.

Repeat use of reference characters throughout the present specification and appended drawings is intended to represent same or analogous features or elements of the invention.

DETAILED DESCRIPTION OF THE PREFERRED EMBODIMENTS

It will be understood throughout the subject specification that different uses and applications of the subject invention may be practiced, in conjunction with modifications and variations of specific features within the spirit and scope of the invention. The disclosure herewith is suggestive of various alternatives, but does not attempt to set forth all possible variations.

FIG. 1 illustrates an exemplary lifting apparatus for receptacle dumping apparatus generally 20 mounted on an exemplary rear load refuse collection truck generally 22. One or more of lifting devices 20 may be secured to a rear area such as bumper 24 of truck 22 for emptying the contents of a residential refuse collection cart generally 26 into a rearward opening generally 28 of truck 22. As well known to those of ordinary skill in the art, cart 26 is generally of the above-referenced domestic design, and includes a pair of opposing latch engagement surfaces 30 and 32 by which the cart is engaged, raised, and dumped.

Lifting apparatus 20 in accordance with such exemplary embodiment of the subject invention has a relatively shortened face plate area generally 34 so that there is a substantial amount of clearance between the bottom portion 36 of lifter 20 and the road surface 38. Such relatively compact size permits advantageous use of lifter 20 in other arrangements, such as side truck mounts or container box mounting arrangements, as discussed below. An operator hand valve 40 may be used for controlling the flow of hydraulic fluid to lifter 20.

Figure 2B:
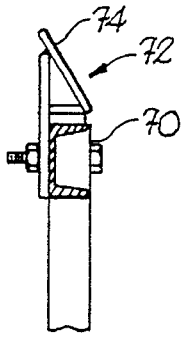
FIG. 2B is an enlarged isolated view of a portion of the FIG. 2A arrangement illustrating kickplate features in accordance with this invention.
Figure 2A:
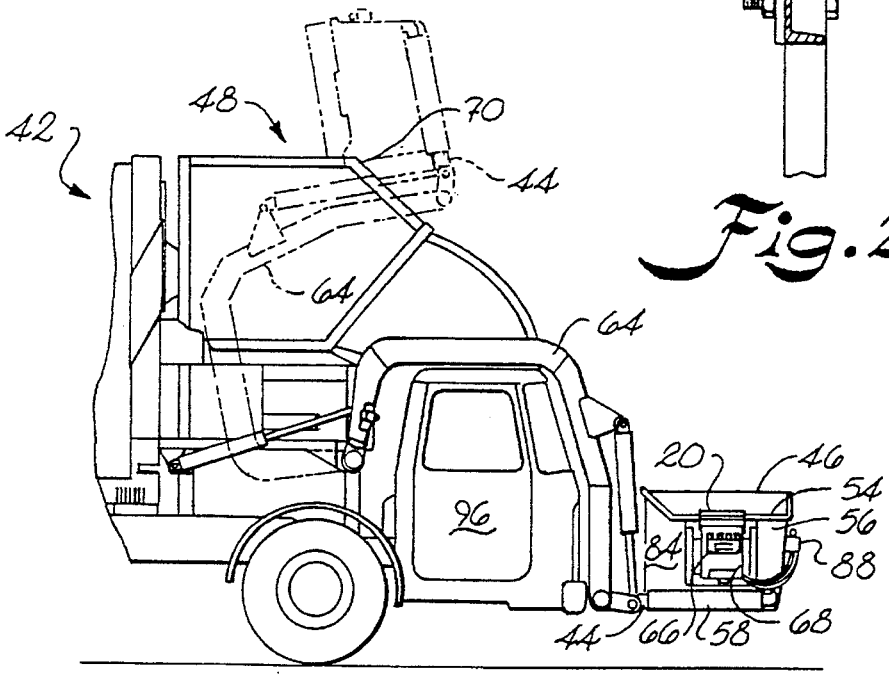
FIG. 2A is a partial side view of a second style of refuse collection truck comprising a front load box arrangement in accordance with an exemplary embodiment of the subject invention.
Figure 3:
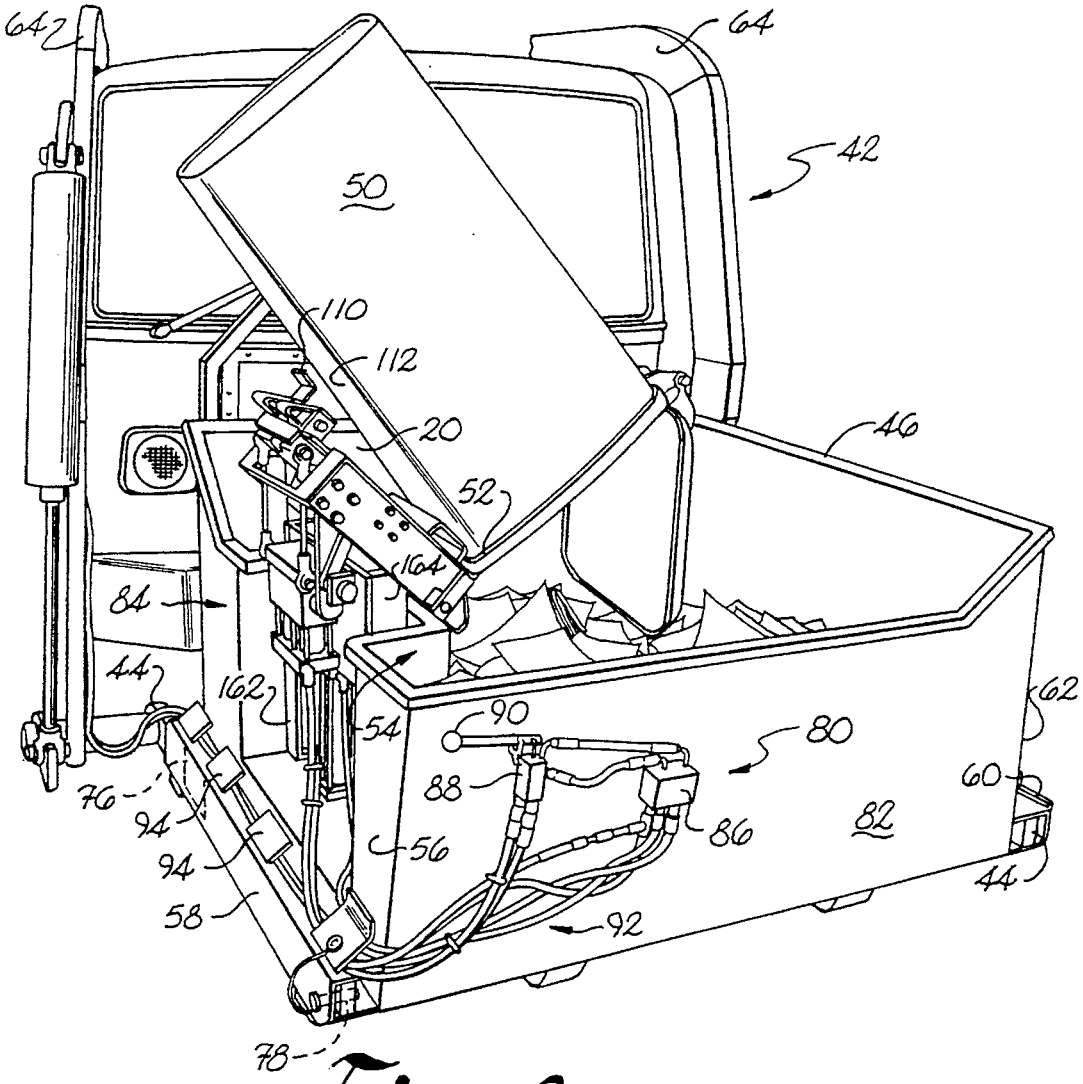
FIG. 3 is a generally forward perspective view of the arrangement of present FIG. 2A, and illustrating operation of an exemplary embodiment of the subject invention in the process of dumping a second exemplary style of conventional cart for residential refuse collection.

FIG. 2A represents a partial side view of a second style of refuse collection truck generally 42, which is also shown in a generally forward perspective view in present FIG. 3. Such truck has a pair of front forks 44 for raising and dumping a relatively larger container box 46 into a refuse hopper having an upper opening generally 48.

Container box 46 may be provided in accordance with the subject invention with a lifting apparatus 20 mounted thereon. While different forms of lifters may be utilized in the present arrangement, the subject lifter 20 advantageously comprises a combination cart lifter per the subject invention for automatically engaging and lifting residential refuse collection carts of different styles having either one or two lift pickup points. For example, lifter 20 can be used with a domestic style can 26 having two pickup points 30 and 32, or with a European style can generally 50 (FIG. 3) having a single lift pickup point such as molded lip 52.

Container box 46 in accordance with the subject invention in general comprises a front end load container box having a substantially open top into which refuse from residential collection carts is dumped for subsequent dumping into hopper 48. A relatively recessed lifter mounting area 54 is provided on one lateral side 56 of box 46. In such area, a lifter 20 or other present lifter embodiment is mounted, as discussed below. A pair of fork channels 58 and 60 are provided on opposing lateral sides 56 and 62 of box 46 for support of such box on the front forks 44 of the top loading refuse collection truck 42. With such arrangement, refuse dumped into container box 46 may be subsequently dumped into hopper 48 of truck 42.

While container box 46 may comprise various sizes, such as holding anywhere from about 1 to about 3 cubic yards of refuse, it is preferred that box 46 be matched with the size of hopper opening 48 so as to maximize the amount of refuse dumped in a given dumping cycle utilizing the large dump arms 64 of truck 42.

Present FIG. 2B is an enlarged isolated view of a portion of the FIG. 2A truck arrangement illustrating certain present kickplate features in accordance with this invention which further serve to maximize dumping efficiency in the following manner. More specifically, as discussed in detail below, lifter 20 includes thereon a hinged or pivoting saddle generally 66 which projects outwardly from the front of face plate 68. As box 46 is dumped (dotted line illustration of present FIG. 2) such projecting hinged saddle would tend to interfere with an upper portion of a near wall 70 forming hopper opening 48. A kickplate 72 is shown in partial cross section in present FIG. 2B as having an angled surface 74 which is positioned on wall 70 so as to engage projecting lift saddle 66 and pivot same into a retracted position as the container box 46 is dumped carrying the lifter 20 thereon. Such an arrangement permits the container box size to be relatively maximized resulting in minimized container box dumping cycles.

The fork channels 58 and 60 may include therein guide means comprising internal angled plates 76 or the like for relatively tightening the fit of the truck front forks 44 therein. Similarly, removable pins 78 or the like may be provided for further securing the position of the fork distal tips. The purpose of such features is to prevent relative movement (particularly in the lateral direction) of the container box 46. For example, the lateral width of the hopper opening 48 may typically be about 80 inches, while the total lateral width of box 46 may be made in accordance with the subject invention to be about 78 inches. Typically the outside lateral distance of forks 44 is fixed at 7.5 inches. Those of ordinary skill in the art will understand that maximizing size of hopper 46 therefor necessarily involves very close tolerances during the dumping cycle. Use of the above-referenced guide means and tightening features in accordance with this invention therefore contributes to maximizing efficiency, as does use of the kickplate features 72 in combination with a lifter 20 in accordance with the subject invention.

As will be discussed in greater detail below with reference to FIGS. 16A through 19, a hydraulic drive circuit generally 80 may be mounted on box 46. FIG. 3 illustrates an exemplary position thereof on a forward wall 82 of box 46. Other locations may be practiced in accordance with the subject invention, such as surface area 84 on lateral wall 56.

To provide certain cycle control means features in accordance with the subject invention, a dual sequencing valve 86 may be provided in combination with an operator control valve 88 having a single operator control handle 90. Various fluid lines generally 92 such as for passing hydraulic fluids or the like may be routed around and under protective plates 94 back towards interconnections on truck 42 with a source of pressurized fluid. Such interconnections may be of a quick disconnect type, to permit the box 46 to be quickly released from forks 44, permitting truck 42 to be used on other collection routes where already filled or partially filled refuse collection boxes will be engaged by forks 44 and dumped. Therefore, the present arrangement permits highly efficient alternative usage of relatively expensive truck 42.

In addition, the advantageous arrangement of present FIGS. 2A and 3 results in considerable manpower savings and improved operator safety. More specifically, a rear load truck such as 22 typically has a separate driver and lift operator (or operators where more than one lift is utilized). There are certain safety concerns whenever a lift operator is functioning at the rear of a large truck, such as truck 22.

By comparison, the arrangement of present FIG. 2A in accordance with the subject invention makes use of the thickness, size, and weight advantages (i.e., the compact features) of lifter 20 for providing a front end load box location. With such an arrangement, only the driver of truck 42 is needed since he can bring the box 46 into a position adjacent a curb side cart, step down from doorway 96 and operate lifter 20. It has been estimated that such an arrangement saves 3,000 to 4,000 operator steps per day, while also improving overall safety of operations. The movement savings alone account for a tremendous time savings in the overall route operations, including the improved route flexibility for truck 42 in accordance with further aspects of the subject invention. For example, the same truck 42 may be used during the day for residential duty (using container box 46 in accordance with the invention) and at night time on a commercial run route (with box 46 removed) for dumping commercial containers.

Figure 4:
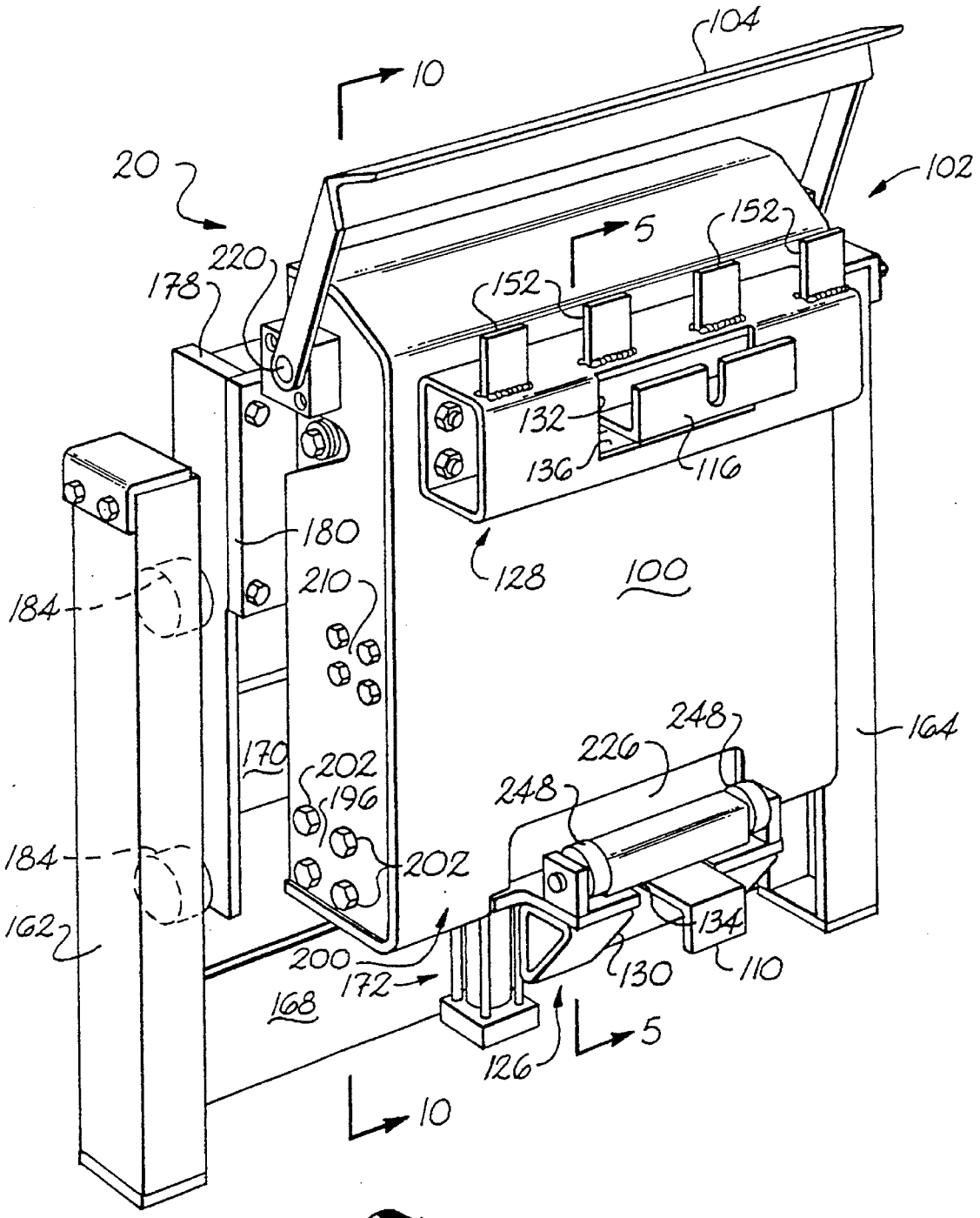
FIG. 4 is a generally front perspective view of an exemplary embodiment in accordance with the subject invention.
Figure 5:
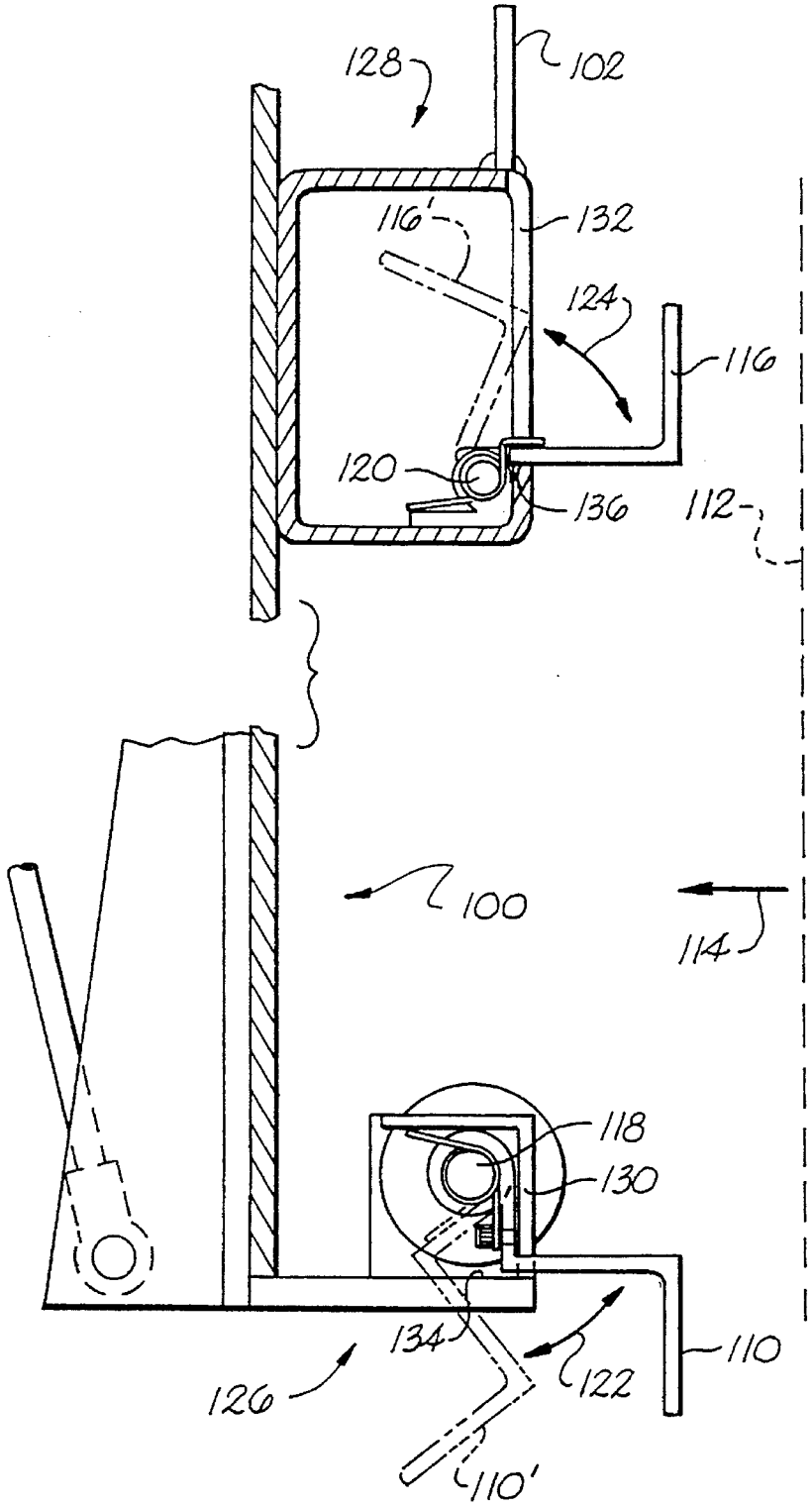
FIG. 5 is an enlarged partial cross-sectional view of portions of the embodiment of present FIG. 4, taken along sectional line 5—5 therein.
Figure 10:
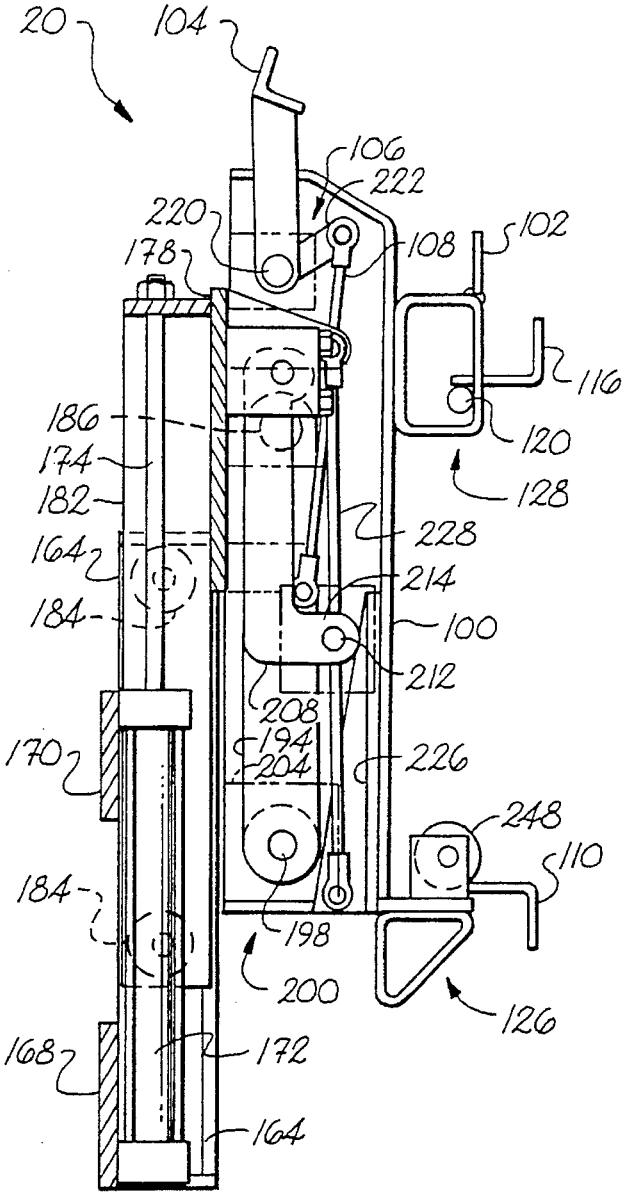
FIG. 10 is a cross-sectional view of an exemplary embodiment in accordance with the subject invention as shown in FIG. 4, taken along the sectional line 10—10 therein.

Present FIG. 4 is a generally front perspective view of an exemplary embodiment generally 20 of a lifting apparatus or receptacle dumping apparatus in accordance with the subject invention. FIGS. 5 and 10 represent specific cross-sectional views thereof taken along the respective sectional lines 5—5 and 10—10 as indicated in such FIG. 4.

Lifter 20 comprises a combination cart lifter for automatically engaging and lifting residential refuse collection carts of different styles, as explained hereinafter. A lift plate or main face plate 100 is provided for receiving thereon a refuse collection cart to be emptied. Lift plate 100 is movable between a lowered upright position thereof (which is the position illustrated in present FIG. 4) for receipt of a receptacle or cart and a raised inverted position thereof, discussed in greater detail below) for dumping the contents of the received cart. Drive means are provided for moving lift plate 100 between such respective positions, and may comprise a variety of actuating arrangements. One preferred exemplary embodiment comprises a hydraulically actuated rotary motor, and may comprise such an arrangement as examples of are disclosed in U.S. Pat. No. 4,773,812 to Bayne et al., herein fully incorporated by reference.

Various cart engagement means in accordance with the subject invention are associated with lift plate 100 for engaging a cart to be emptied for movement of such cart with lift plate 100. In a preferred combination cart lifter, such cart engagement means comprises both cart clamping means for clamping on lift plate 100 a refuse collection cart of the type having a single upper lip to be clamped during lifting, such as cart 50 in present FIG. 3, and further includes cart latching means for latching on lift plate 100 a refuse collection cart of the type having a pair of opposing latch engagement surfaces, such as cart 26 of present FIG. 1. Other present designs may include only one or the other means for engaging a cart, when combined with other present features.

Present cart clamping means in accordance with the subject invention may comprise a lower clamping member generally 102 relatively fixedly carried on lift plate 100 for engaging a relative lower side of a single lip 52 of cart 50. Such cart clamping means further includes an upper clamping member generally 104 supported in relatively movable relationship with lift plate 100 for engaging a relatively upper side of the cart single lip 52. Further provided are clamp actuation means generally 106 for closing clamp bar 104 towards lip 52. By providing such a movable clamp bar 104, clamping of cart lip 52 occurs at a relatively earlier point in time during a dumping cycle than it otherwise would, providing certain specific advantages discussed below.

The clamp actuation means 106 includes at least one linkage generally 108 between movable upper clamping member 104 and other members which move during the dumping cycle, thereby providing movement of clamp arm 104 as discussed below.

Exemplary cart latching means in accordance with the subject invention includes a lower latch member generally 110 movably mounted between an extended position thereof (solid line illustrations of present FIGS. 4, 5, and 10) for engaging the lower of cart latch engagement surfaces for domestic style carts and a retracted position thereof (dotted line illustration 110' of present FIG. 5) pivoted relatively downward from its extended position. Such pivoting into a retracted position automatically occurs in response to engagement of a European style cart 50. Such a cart presents to lift plate 100 a generally smooth or flat side surface 112 which advantageously in accordance with the subject invention functions to push engagement member 110 into its retracted position. Such surface 112 is illustrated in dotted line in present FIG. 5 as it would be approaching lip plate 100 in the direction of arrow 114. While present FIG. 3 illustrates dumping of such European style cart 50, the engagement member 110 shown in such FIG. 3 is in its relatively extended position to show that surface 112 may become slightly pivoted away from lift plate 100 at the peak of the dumping cycle (i.e., the fully raised inverted position of cart 50). As shown, lower latch or engagement member 110 may comprise a substantially L-shaped member regarded as comprising a latching or a lift hook.

Exemplary cart latching means in accordance with the subject invention may further include an upper latch member generally 116 which is likewise movably mounted between an extended position thereof (a solid line illustration of present FIGS. 4, 5, and 10) for engaging the upper of cart latch engagement surfaces of domestic style carts and a retracted position thereof (dotted line illustration 116') pivoted relatively upward from its extended position. Again, member 116 preferably is pivoted into its retracted position 116' by presentation of smooth surface 112 of a European style cart (see FIG. 5).

Both lower and upper latch members 110 and 116 are preferably biased into their respective extended positions (solid line illustrations of present FIGS. 4, 5, and 10) so as to engage and lift a domestic style cart of the type having a pair of opposing latch surfaces, as noted above. However, advantageously in accordance with the illustrated exemplary embodiment of the subject invention, such members are pivoted into their respective retracted positions upon contact with surface 112 of a European style or other style cart to permit such cart to be engaged and otherwise lifted with apparatus 20 (such as with the cart clamping means described above).

While member 110 may be regarded as comprising a hinged hook, the upper member 116 may be regarded as comprising a latching or lift saddle. Both such members are preferably rotatably mounted on respective spring-loaded shafts 118 and 120. Other forms of resilient and pivotable mounting may be practiced in accordance with the broader aspects of the subject invention, so long as engagement members 110 and 116 are generally movable in the direction of respective double-headed arrows 122 and 124 (see FIG. 5).

Latch members 110 and 116 are preferably associated with respective mounting brackets generally 126 and 128. Such brackets include respective openings therein 130 and 132 into which their respective latch members are pivoted when in their retracted positions. Respective housing surfaces 134 and 136 adjacent such housing openings help support respective engagement members 110 and 116 in their extended positions. With such an arrangement, the engagement members are adequately rigid for performing their grasping functions during the dumping of appropriate styles of carts.

Figure 6A:
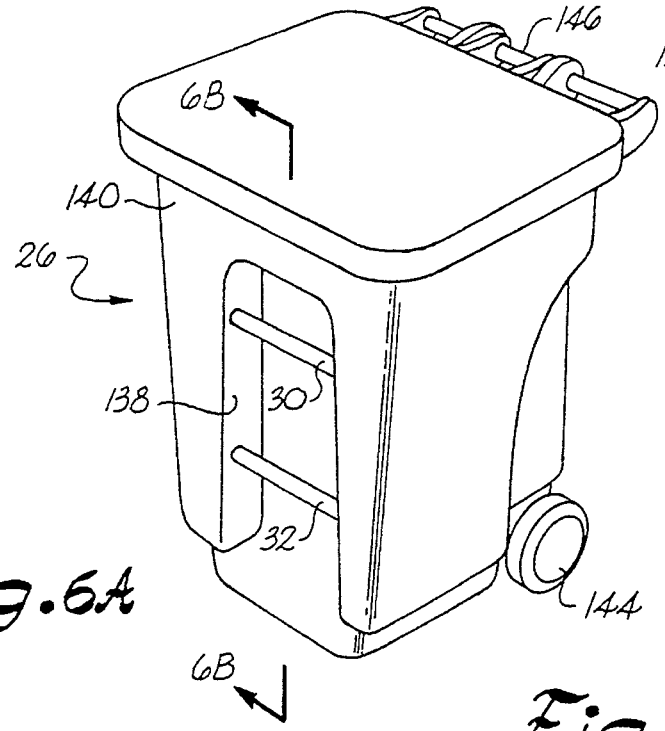
FIG. 6A is a generally forward perspective view of a first exemplary conventional cart for residential refuse collection.
Figure 6B:
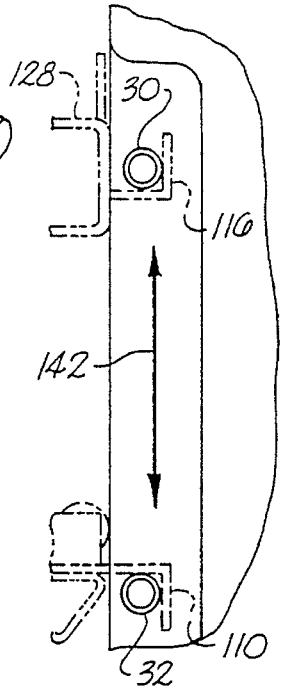
FIG. 6B is a partial cross-sectional view of the conventional cart of FIG. 6A shown in use with certain exemplary features in accordance with the subject invention (illustrated in dotted line), taken along the sectional line 6B—6B of such FIG. 6A.

Present FIG. 6A is a generally forward perspective view of a first exemplary conventional cart generally 26 as comprising the above-referenced domestic style cart. Cart 26 has a pair of lift engagement members comprising bar 30 and 32 which are engaged by respective members 116 and 110 in accordance with the subject invention. Present FIG. 6B illustrates such engagement by representing a partial cross-sectional view of receptacle 26 taken along sectional line 6B—6B of present FIG. 6A. Cart features are illustrated in solid line while lifter features in accordance with the subject invention are illustrated in dotted line in present FIG. 6B.

As shown, the outwardly projecting or extending position of latch members 110 and 116 penetrates a recessed area 138 in the face 140 of cart 126. The vertical axis of such cart 26 runs in the direction of double-headed arrow 142 of present FIG. 6B. As discussed below in detail, latch engagement members 110 and 116 are moved respectively and oppositely in axially outward directions along axis 142 so as to engage bars 30 and 32 as illustrated in present FIG. 6B. As represented in present FIG. 5, axially outward forces along axis 142 rotate latch members 110 and 116 into their respective retracted positions.

Figure 7A:
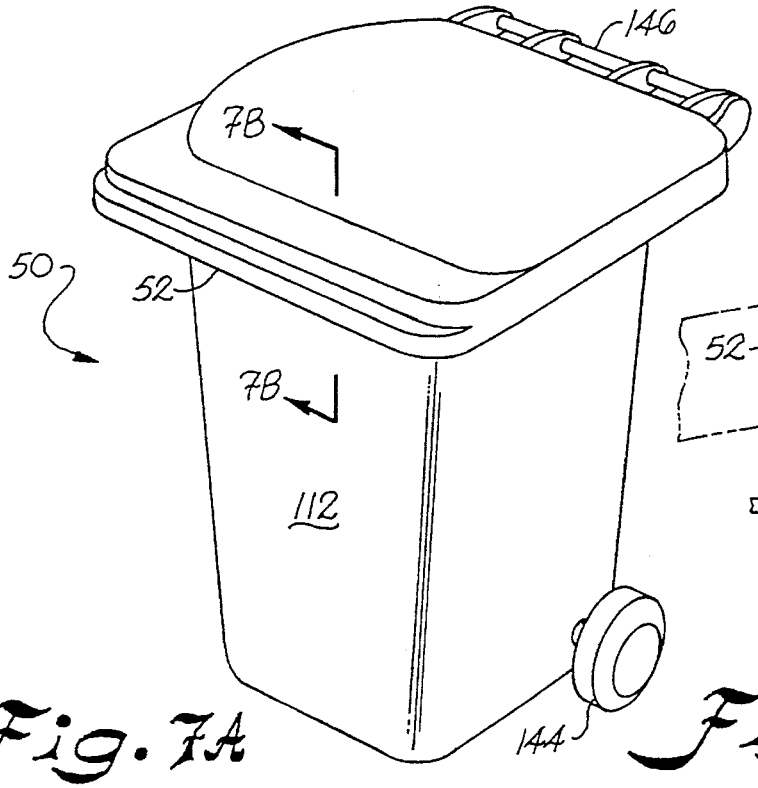
FIG. 7A is a generally forward perspective view of a second exemplary conventional cart for residential refuse collection.

Present FIG. 7A is a generally forward perspective view of the second exemplary conventional cart comprising a European style cart generally 50, having a molded or reinforced upper lip 52 and a relatively smooth side surface 112 in place of the recessed region 138 of cart 26. Both carts 26 and 50 have wheels 144 or similar and handles 146 by which a resident rolls the cart to a generally curb side location for truck pickup.

Figure 7B:
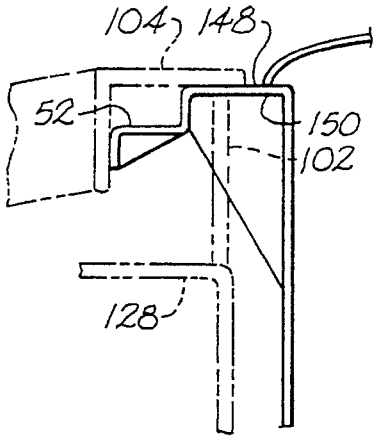
FIG. 7B is a partial cross-sectional view of the ccnventional cart of FIG. 7A shown in use with certain exemplary features in accordance with the subject invention (illustrated in dotted line), taken along the sectional line 7B–7B of such FIG. 7A.

Present FIG. 7B is an enlarged partial cross-sectional view of cart 50 (shown in solid line) illustrated in use with certain exemplary features in accordance with the subject invention (which are illustrated in dotted line in FIG. 7B), taken along the sectional line 7B—7B of present FIG. 7A. As illustrated, movable clamp bar 104 in accordance with this invention engages the relatively upper side 148 of cart lip 52 while relatively fixed engagement member 102 in accordance with this invention engages a lower side 150 of lip 52. As will be understood by those of ordinary skill in the art from the present disclosure, the upper engagement member or lift saddle 116 in accordance with cart latching means of the subject invention is pivoted into a retracted position so as to not interfere with lip 52 being brought into clamping arrangement with present cart clamping means. The actuation of such clamping features and timing thereof is discussed in greater detail below, by which an appropriate clamping effect takes place without overcrushing or underclamping lip 52. Clamping members 102 may comprise different embodiments such as relative finger bar elements 152 of present FIG. 4. Other configurations may be practiced. For example, engagement members of other predetermined shapes may be provided for mating with pockets of corresponding predetermined shapes carried on a top portion or upper side surface of other appropriate cart designs.

FIGS. 8A through 8D are respective side elevational view of the exemplary cart of present FIG. 6A shown in combination with an exemplary embodiment generally 20 of a lifting apparatus in accordance with the subject invention. FIGS. 8A through 8D illustrate in sequence a portion of a dumping cycle in accordance with this invention, including representing use of certain present optional vertical lift assembly features generally 154.

Vertical adjustment means generally 154 are provided in accordance with the subject invention for relatively vertically shifting the position of lift plate 100 and features associated therewith between an initial null position thereof and a variably raised engaging position thereof at which various cart engagement features of the subject invention are positioned for engaging at least one predetermined lift engagement member on a cart to be emptied.

Figure 8A:
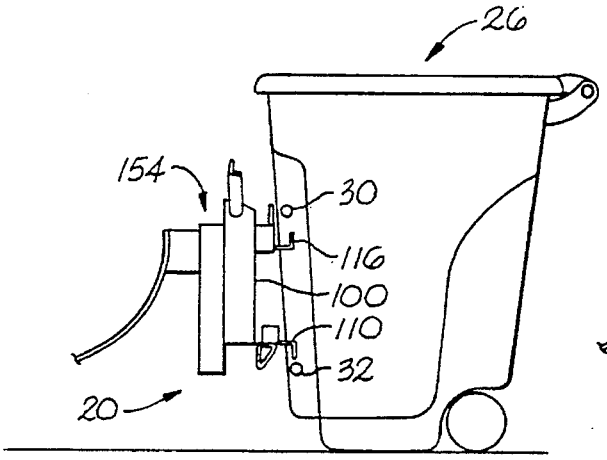
FIGS. 8A through 8D are respective side elevational views of the exemplary cart of present FIG. 6A shown in combination with an exemplary embodiment in accordance with the subject invention, and illustrating in sequence a portion of a dumping cycle in accordance with this invention, including representing use of certain present optional vertical lift assembly features.

FIG. 8A illustrates an exemplary such null position of the vertical adjustment means. As illustrated, the upper latching member 116 is situated well below the height of upper engagement bar 30 of cart 26. Without any actuation of drive means for controllably moving lift plate 100 towards its raised position, the vertical adjustment means 154 begins to raise the lift plate 100 and related features, as shown in FIG. 8B.

Figure 8B:
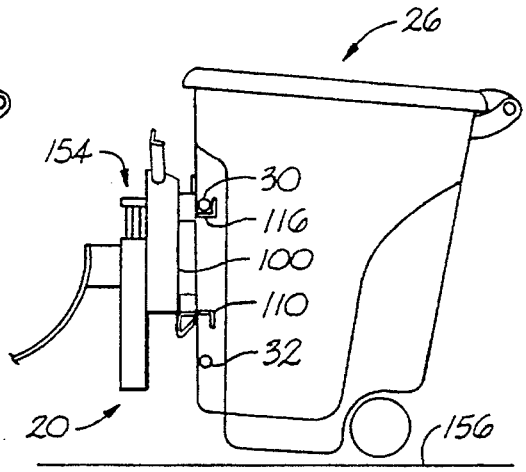

FIG. 8B represents a point in the overall dumping cycle of an exemplary embodiment generally 20 wherein the vertical adjustment means has raised lift plate 100 and associated member upper latch 116 a variable height for engaging bar 30. Because of different cart sizes, the initial height of bar 30 is generally unknown. However, as explained below, cycle control means in accordance with the subject invention, for example, various hydraulic sequencing valves, permits upward movement of lift plate 100 until bar 30 is engaged and cart 26 is just slightly raised from surface 156 (as shown in FIG. 8B).

Figure 8C:
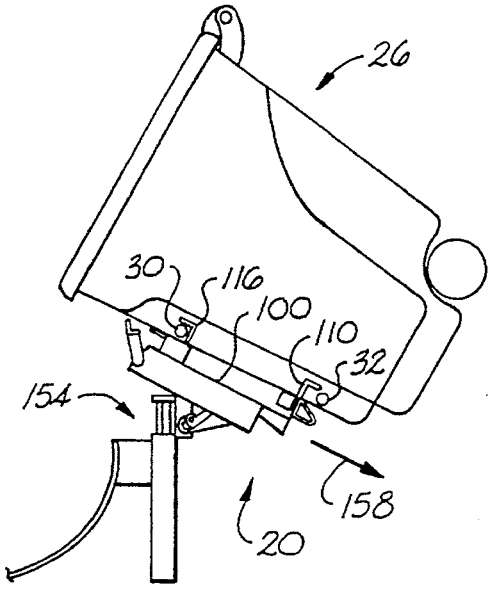

Once the cart engagement portion of the cycle as represented by FIG. 8B is completed, present cycle control means cause cessation of the vertical lifting with vertical adjustment means 154 and start of cart lifting and dumping with face plate 100 moved by the associated drive means. FIG. 8C represents such time period of the dumping cycle, and illustrates that latch element 110 is being moved generally in a downward longitudinal axis direction 158 so as to eventually engage bar 32 for holding cart 26 onto face plate 100.

Figure 8D:
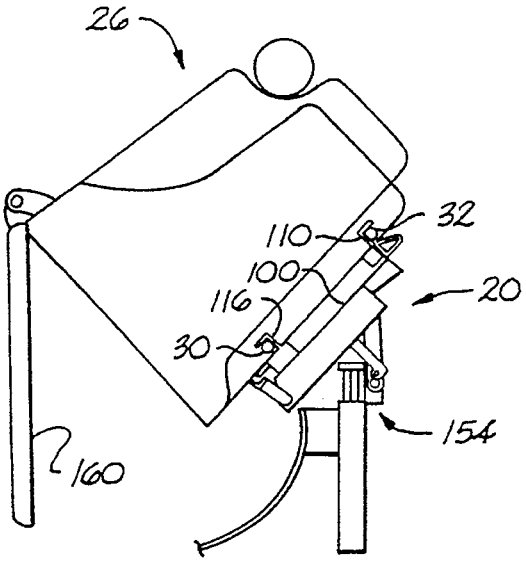

As the dumping cycle continues so that face plate 100 assumes its fully raised inverted position as shown in present FIG. 8D, lower latch member 110 becomes fully engaged with bar 32. Gravity causes the lid 160 of cart 26 to open for dumping the contents of such cart into a refuse collection vehicle or a container box such as exemplary box 46 of present FIGS. 2A and 3.

Present cycle control means associated with vertical adjustment means 154 and the drive means of lifter 20 first variably operates the vertical adjustment means 154 so as to engage the cart engagement means (latch 116) with at least one lift engagement member (bar 30) of cart 26 to be emptied, the height of which bar 30 is not specifically or initially known. Thereafter, cycle control means operates automatically the drive means so as to lift and dump the contents of the engaged cart, as shown.

Once the contents of cart 26 are dumped, the cycle represented by present FIGS. 8A through 8D is generally reversed. In other words, first the cart 26 is returned to its relatively lowered upright position shown in present FIG. 8B by reversing the movement of face plate 100. Once achieving the position of FIG. 8B, the vertical adjustment means are operated for again lowering the face plate 100 until the position of FIG. 8A is obtained. During the face plate lowering operations of FIGS. 8D through 8B, lower latch member 110 is in effect retracted in accordance with certain present face plate extension means features, as discussed in detail below.

FIGS. 9A through 9D are similar to FIGS. 8A through 8D, respectively, illustrating side elevational views of the present exemplary combination cart lifter 20, but with use thereof with the exemplary European style cart 50.

The phases of the dump cycle are generally the same for representations of present FIGS. 9A through 9D as they are for respective FIGS. 8A through 8D. The chief difference is that smooth surface 112 of cart 50 has caused respective latch members 110 and 116 to be pivoted in axially outward directions (in relation to axis 142 of present FIG. 6B) into their respective retracted positions, thereby permitting lifting and dumping of cart 50 with present cart clamping means and clamp actuation means features.

Figure 9A:
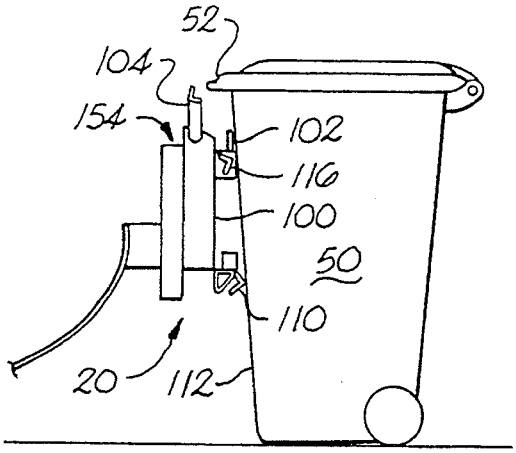
FIGS. 9A through 9D are respective side elevational views of the exemplary cart of present FIG. 7A shown in combination with an exemplary embodiment in accordance with the subject invention, and illustrating in sequence a portion of a dumping cycle in accordance with this invention, including representing use of certain present optional vertical lift assembly features.
Figure 9B:
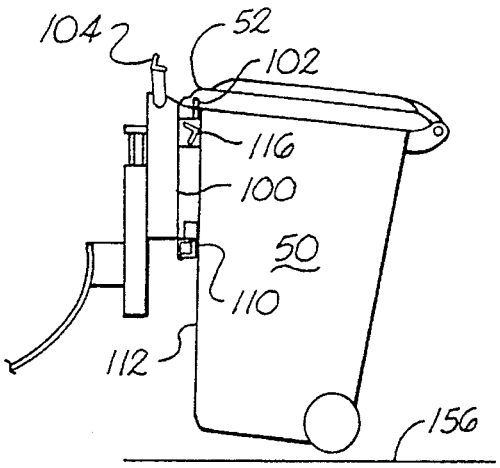
Figure 9C:
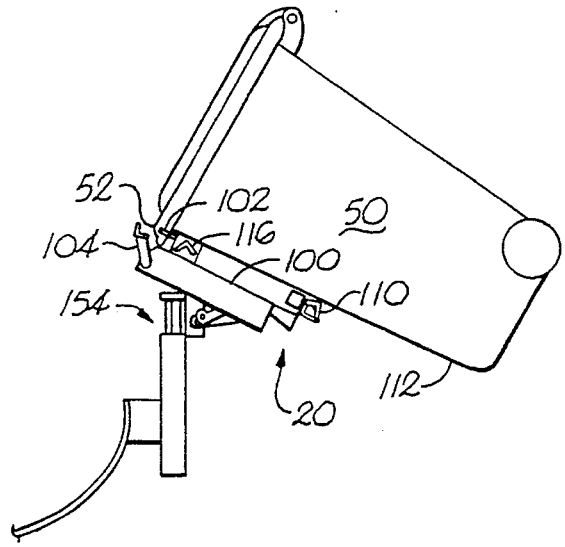
Figure 9D:
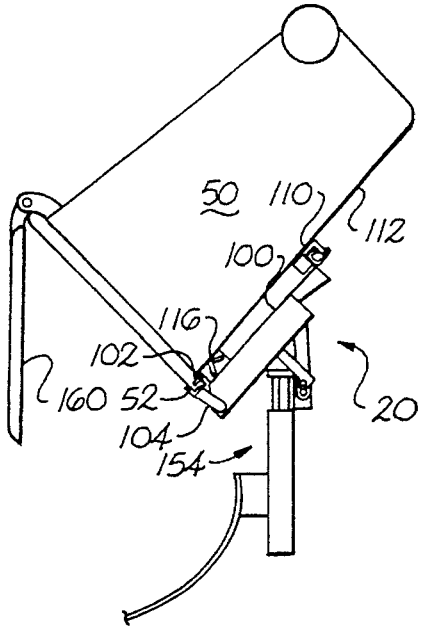

As further shown, operation of vertical adjustment means 154 causes engagement member 102 to become seated against the underside of lip 52 so that cart 50 is slightly raised from ground 156 (FIG. 9B). Thereafter, cycle control means or hydraulic sequencing features in accordance with the invention causes hydraulic drive power to be shifted from the vertical adjustment means 154 to the drive means so that face plate 100 begins to be moved towards its raised inverted position. Clamp actuation means, discussed in greater detail below, begin to cause movable clamp arm 104 to move towards the upper side of lip 52 and clamp same before the fully raised inverted position (FIG. 9D) is obtained. As well known to those of ordinary skill in the art, securement of both sides of lip 52 serves the same function relative cart 50 as respective single-sided engagement of the two opposing bar engagement elements 30 and 32 relative cart 26.

Once the contents of cart 50 are dumped (FIG. 9D) the cycle may again be reversed to the point of lowering cart 50 to its FIG. 9A position, in the same manner as discussed above with reference to FIGS. 8A through 8D. Also, similarly to the description of FIGS. 8A through 8D, the vertical adjustment means automatically variably raises lift plate 100 and corresponding engagement member 102 to an appropriate height for engaging the underside of lip 52, regardless of the initially unknown height of such lip above ground surface 156. Different heights of such lip 52 may be encountered due to differences between various manufacturers or differences in cart sizes.

Figure 14:
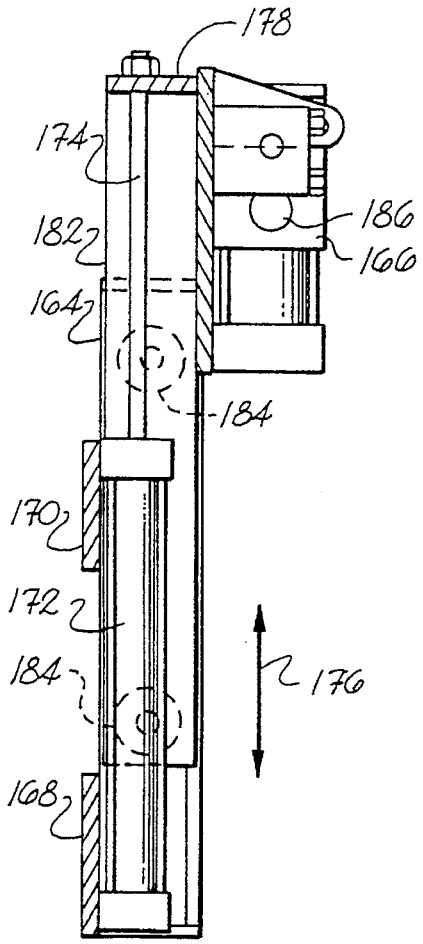
FIG. 14 is a partial cross-sectional view of the exemplary embodiment of present FIGS. 4 and 10 more particularly illustrating present optional vertical lift assembly features thereof.
Figure 11:
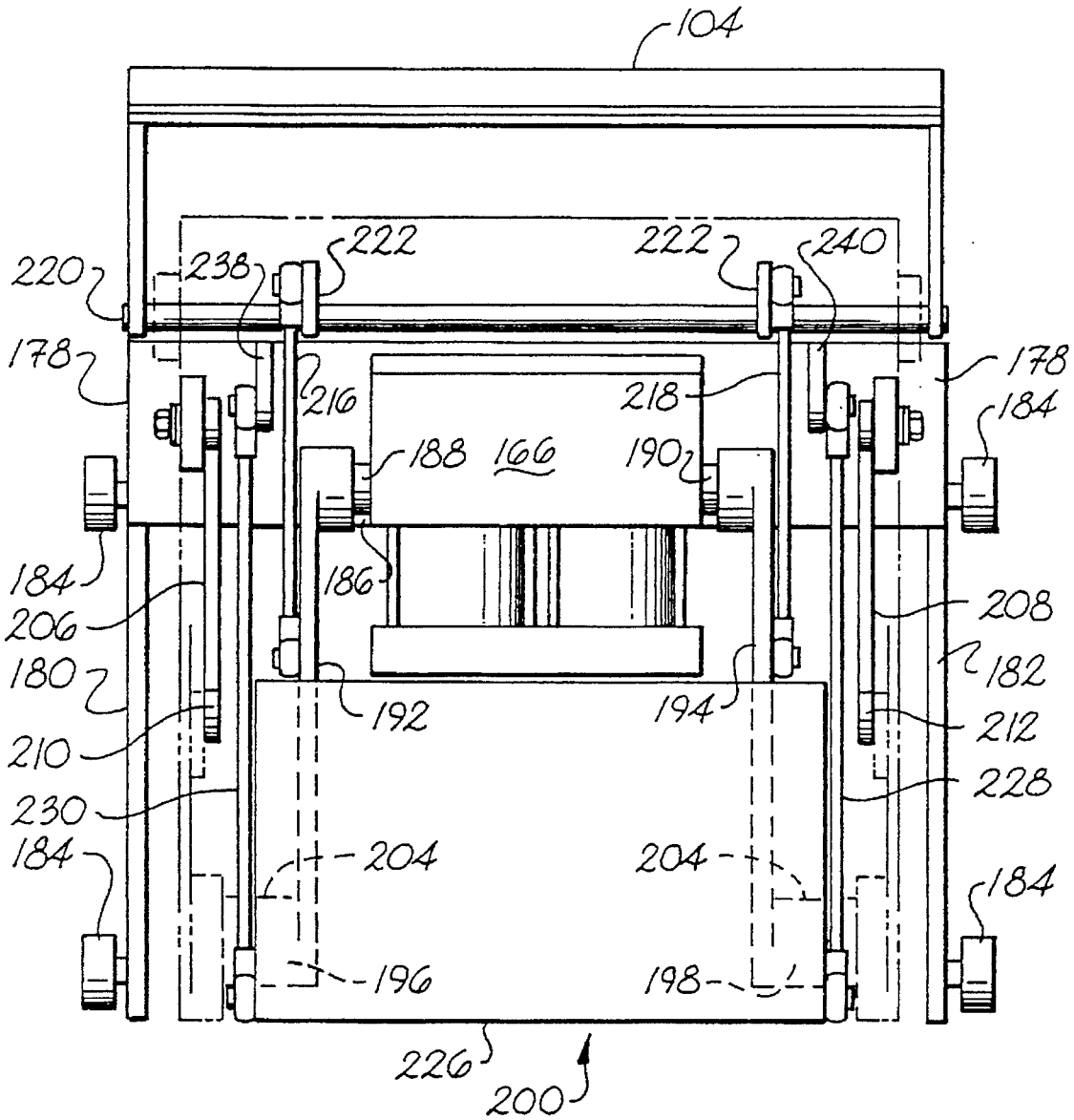
FIG. 11 is a generally rear perspective view of the embodiment of present FIG. 4, though without express illustration of certain present optional vertical lift assembly features.

FIG. 11 is a generally rear perspective view of the embodiment of FIG. 4 of a lift unit generally 20, though without express illustration of certain present optional vertical lift assembly features thereof. However, FIG. 14, is a partial cross-sectional view of the exemplary embodiment of present FIGS. 4 and 10 more particularly illustrating certain present optional vertical lift features thereof, as discussed hereinafter.

Vertical adjustment means (present optional vertical lift assembly features) in accordance with this invention may include a pair of laterally positioned and separate vertical guides 162 and 164 (see also FIG. 4). Such guides may directly be secured to a primary support such as a refuse collection vehicle or container box as represented in present FIG. 3. In either event, the lift plate 100 and drive means generally 166 (FIG. 14) are movably supported in relation to such vertical guides. A support element such as one or more generally horizontal crossing members 168 and 170 may be associated with the vertical guides for further strengthening the arrangement and for providing support of other features mentioned hereinafter.

A specific actuation device such as a hydraulic lifting cylinder generally 172 may be interconnected between the support elements 168 and/or 170 and the lift plate 100 and/or drive means 166. Actuation of the hydraulic lifting cylinder reciprocates an actuation rod 174 thereof for its movement along the direction of double-headed arrow 176 (FIG. 14). With such actuation movement, the drive means 166 and lift plate 100 (and any other features associated therewith such as latch members 116 and 110) are moved relative to the vertical guides 162 and 164.

Drive means 166 may in fact preferably be secured to a support frame 178 which may in turn further include a pair of generally vertical support elements 180 and 182 with roller elements 184 thereon, which roller elements 184 are received directly in the vertical guide channels 162 and 164.

Hydraulic drive circuit features operative with the above-referenced vertical lift assembly means and related features are discussed in greater detail below with reference to present FIGS. 16A through 19. In general, such hydraulic drive circuit is operative for first applying hydraulic drive power to hydraulic lifting cylinder 172 so as to lift the main lift carriage or face plate 100 and related features until either the first support bar or finger support bar 102 or the lift saddle 116 engages an appropriate lift pickup point of the corresponding refuse collection cart type, and thereafter automatically diverts hydraulic drive power from cylinder 172 to a hydraulically actuated rotary motor 166 so as to lift and dump the refuse collection cart engaged on the main lift carriage 100.

With collective reference to present FIGS. 4, 10, and 11, the following description explains in detail various clamp actuations means in accordance with the subject invention. Generally speaking, drive means 166 may comprise a hydraulically actuated rotary motor having a transverse output shaft 186 with respective ends thereof 188 and 190. A pair of torque arms 192 and 194 are received in fixed rotational relationship on opposing respective ends 188 and 190 of the drive means output shaft 186 for being rotated therewith. The opposite ends of torque arms 192 and 194 are pivotably (i.e., rotatably) mounted on the main lift carriage or face plate 100 at points 196 and 198 adjacent a base portion generally 200 of face plate 100. Bolts 202 (FIG. 4) represent a bearing 204 or similar pivot mounting in which the appropriate ends of torque arms 192 and 194 may be received.

A pair of idler arms 206 and 208 may also be pivotably supported at respective first ends thereof on the support frame generally 178 or the housing for drive means 166, and at respective second ends thereof on the main lift carriage or face plate 100. The attachment points generally 210 and 212 are respectively relatively displaced from the base portion 200 of face plate 100 and relatively displaced from attachment points 196 and 198 of torque arms 192 and 194. Attachment bolts and bearings may also be used at points 210 and 212. With such an arrangement, the main lift carriage is raised and inverted by the torque idler arms responsive to predetermined rotation of the drive means output shaft 186, as discussed in greater detail below with reference to present FIGS. 12A through 12E. The additional respective bends 214 formed in the idler arms advantageously permits additional leverage for further displacing the contents of a cart being emptied into a refuse collection vehicle or container box. Timing changes may also be made with such bends, as noted below.

Clamp actuation means in accordance with the subject invention are operative for closing the relatively movable upper clamping member 104 towards the relatively fixed lower clamping member 102 as the drive means 166 operates. Such functioning is achieved by providing at least one linkage 108 between such clamp arm 104 and one of the moving torque or idler arms 192, 194, 206, or 208. Since such torque or idler arms comprise interconnecting arms operatively interconnected between drive means 166 and lift plate 100 for imparting movement thereto, the clamp actuation means by such linkage 108 is functional in response to operation of such drive means 166. The length and/or connection positioning of such linkage 108 may be adjusted so as to correspondingly adjust or vary the timing of actuation of clamp 104 in relation to operation of the drive means 166. By such arrangement, both the full clamping movement of clamp 104 and the timing thereof may be adjusted so as to ensure adequate engagement of cart 50 on lift plate 100 without overcrushing the lip 52 thereof, which could result in damage to cart 50.

More preferably, the clamp actuation means linkage includes a pair of rods operatively interconnected with the movable upper clamping member 104 and at least two of the torque and/or idler arms. Present FIG. 11 illustrates interconnection of such exemplary arms 216 and 218 to torque arms 192 and 194, respectively, although it is to be understood that alternative interconnections such as with idler arms 206 and 208 could be practiced. It is to be further understood that clamp arm 104 is preferably pivotably mounted such as about a support shaft 220 and interconnected through a further pair of shortened linkages 222 to ensure the proper application of rotational force in relation to such shaft 220.

Figure 15:
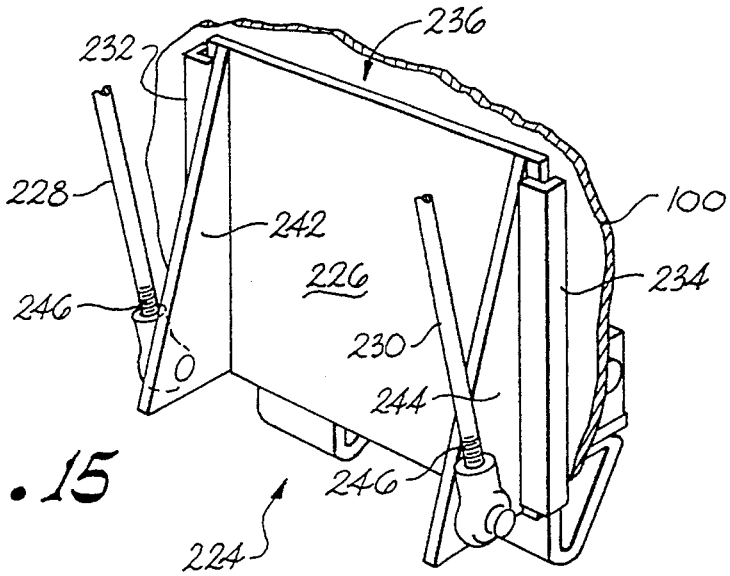
FIG. 15 is an isolated view of a portion of the exemplary embodiment of present FIGS. 4, 10, and 11 showing further features thereof in accordance with present sliding or extending latch aspects of the subject invention, such as further referenced in conjunction with present FIGS. 8A through 8D.

FIG. 15 represents an isolated view of a portion of the exemplary embodiment of lifter 20 of present FIGS. 4, 10, and 11, showing further features thereof in accordance with the present sliding or extending latch aspects of the subject invention, as described above in conjunction with present FIGS. 8A through 8D and the movement of lower latch member 110 in the direction of arrow 158. More particularly, the subject invention includes face plate extension means or a slide latch assembly generally 224 which is operative during operation of the drive means 166 for moving a face plate extension member 226 between respective retracted and extended positions thereof relative to lower edge or lower portion 200 of main face plate 100. Such retracted and extended positions are obtained in correspondence with respective lowered and raised positions of face plate 100.

The slider latch assembly receives thereon lift hook or lower latch member 110 and the above-described features corresponding therewith, such as the housing 126 therefor. With such an arrangement, the member 110 is extended relative base portion 200 of the face plate generally in the direction of arrow 158 of present FIG. 8C so that lower lift engagement feature 32 of cart 26 becomes latched by lower latch member 110. Carriage extension member actuation means are provided in essence by a pair of arm 228 and 230 which are actuation linkages extending between face plate extension member 226 and a relatively fixed position support (such as some portion of support frame 178) for drive means 166.

The face plate extension means further preferably includes two generally upright slide channels 232 and 234 (FIG. 15) received in generally lateral respective positions on a rearward side 236 of face plate 100. Face plate extension member 226 preferably comprises a generally planar member with respective lateral edges thereof received in sliding relationship respectively in such two slide channels 232 and 234, as shown in present FIG. 15. The actuation linkages 228 and 230 comprise a pair of rigid rods respectively pivotably attached adjacent to lateral bottom edges of face plate extension member 226 and to relatively fixed positions 238 and 240 of support for drive means 166. As shown, such rods are actually supported on triangular or other shaped extensions 242 and 244 and are further secured with threaded arrangements 246 to permit length adjustments of rods 228 and 230, with corresponding time adjustments for extension of member 226 (i.e., engagement of latching member 110).

Still further in accordance with an exemplary embodiment of the subject invention, roller means generally 248 may be carried on the face plate extension member 226 for rotatably engaging a lower portion of a receptacle or cart to be dumped as such cart is being raised. Such an arrangement results in stable lifting of the cart even with a relatively shortened face plate area whenever the main face plate 100 is lowered and the face plate extension member 226 is retracted. Another advantage specifically of the roller means is that it provides for overall smoother operations and less likelihood of scarring or damage to the adjacent side surface or face of a cart being emptied.

FIGS. 12A through 12E are progressive sequence illustrations of partial cross-sectional views of the present exemplary embodiment of present FIGS. 4 and 11, showing more particular lift and dump operations thereof, though without specific illustration of certain present optional vertical lift assembly features which have been described above in detail. Such sequential figures in particular show relative movements of the first support bar 102 and clamp bar assembly with clamp bar 104 in relation to lift plate 100 as it advances from its relatively lowered upright position to its relatively raised inverted position. Also shown are the changing interrelationships of the torque and idler arms in conjunction with the actuation rod 108 for relatively moving clamp bar 104 during such dumping cycle.

In similar fashion, the interrelationship of lower latch member 110 and upper latch member 116 are illustrated in relation to lift plate 100 as it moves between its two respective lowered and raised positions. Shown in conjunction therewith is the changing position and operation of face plate extension means actuation arm 228. Those of ordinary skill in the art will note the changing relative extension of face plate extension member 226 beyond (i.e., below) the base portion 200 of face plate 100 as the illustrations sequentially progress from present FIGS. 12A through 12E.

Figure 12A:
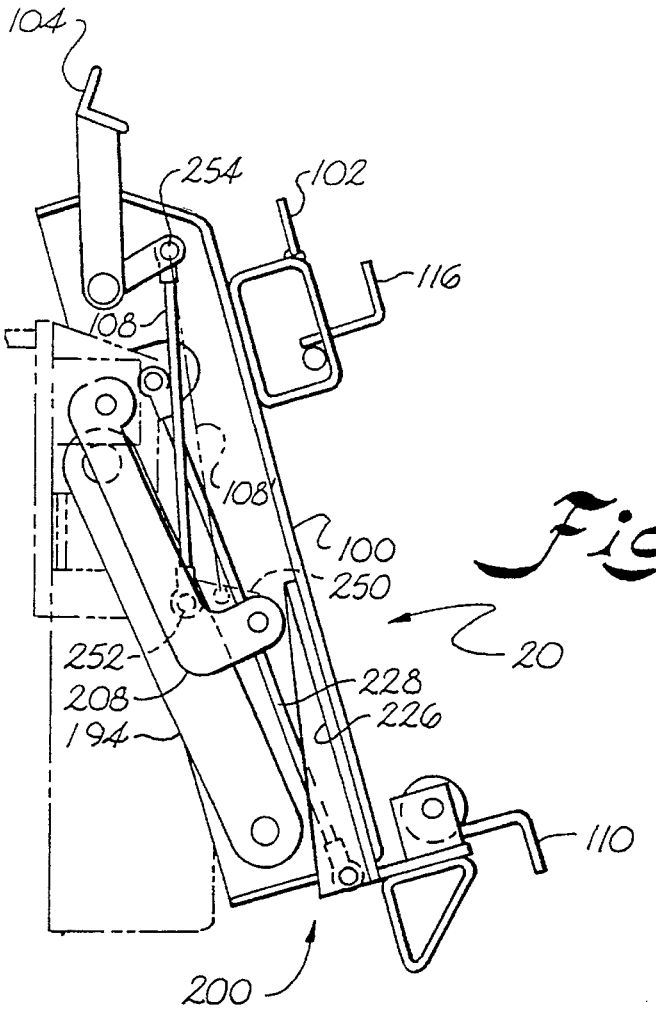
FIGS. 12A through 12E are progressive sequence illustrations of partial cross-sectional views of the present exemplary embodiment of present FIGS. 4 and 11 showing more particular lift and dump operations thereof, though without specific illustration of certain present optional vertical lift assembly features.
Figure 12B:
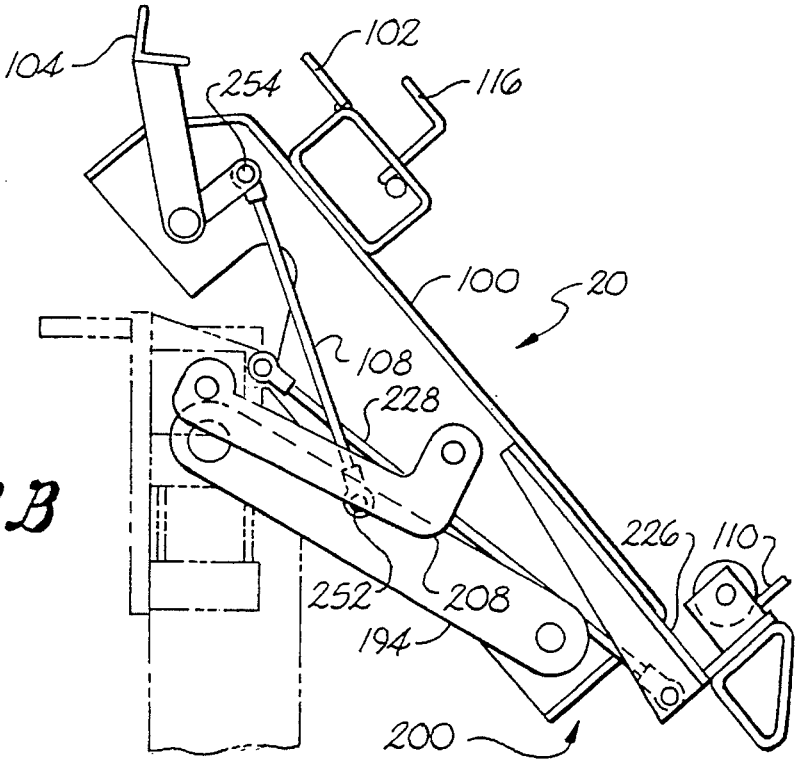
Figure 12C:
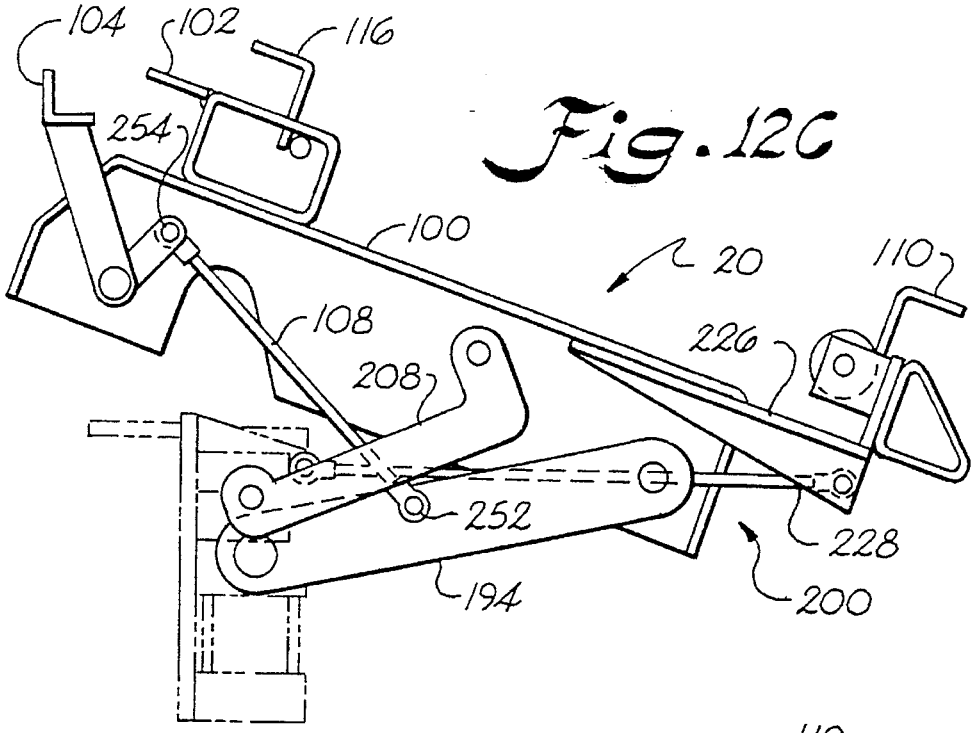
Figure 12D:
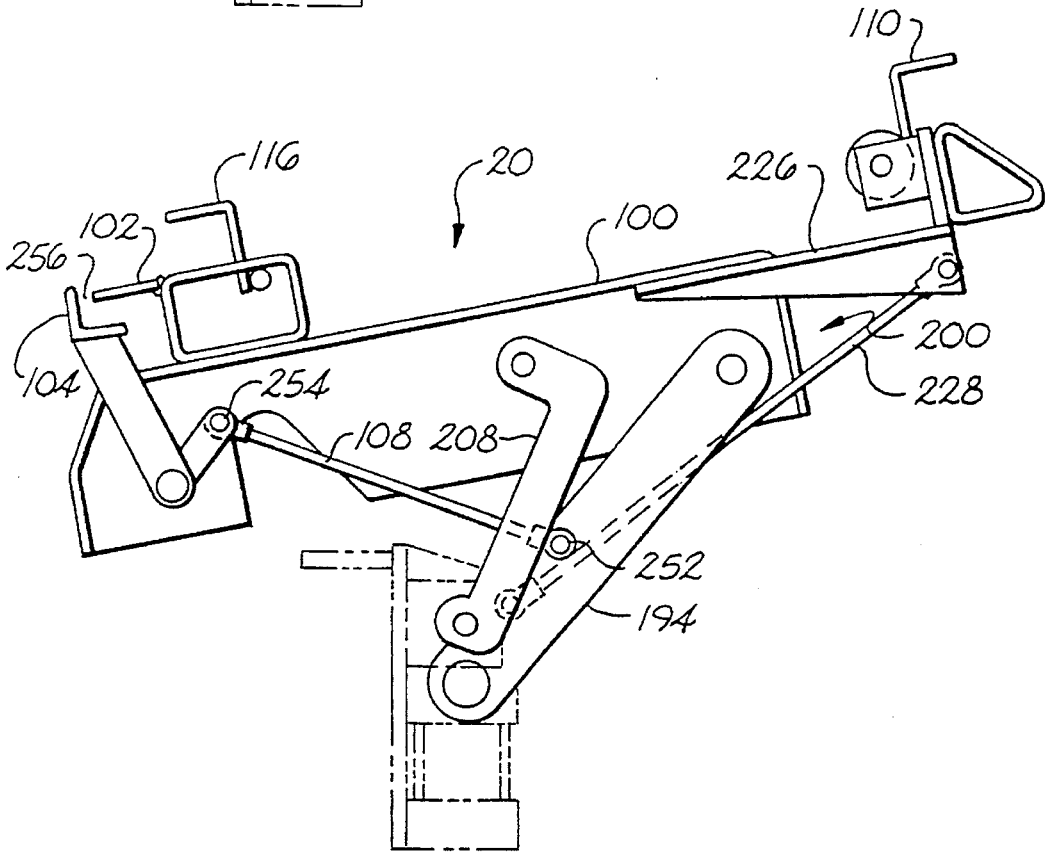

It should be further noted by those of ordinary skill in the art that present FIG. 12A illustrates an alternate attachment point for a dotted line illustration of actuation rod 108'. In such alternate arrangement, the actuation rod 108' is connected to a part of bent arm 208, specifically an illustrated (in dotted line) triangular shaped region 250 thereof. In relation to the solid line illustration of connection at point 252 on torque arm 194, clamp arm 104 is adjusted insofar as timing of closing in relation to operation of drive means 166. Those of ordinary skill in the art will understand and appreciate from the disclosure herewith that other changes in such timing or operation of closure of clamp arm 104 may be made by further adjustments to the length and/or positioning of the interconnection of actuation rod 108 in relation to its other connection point 254.

Figure 12E:
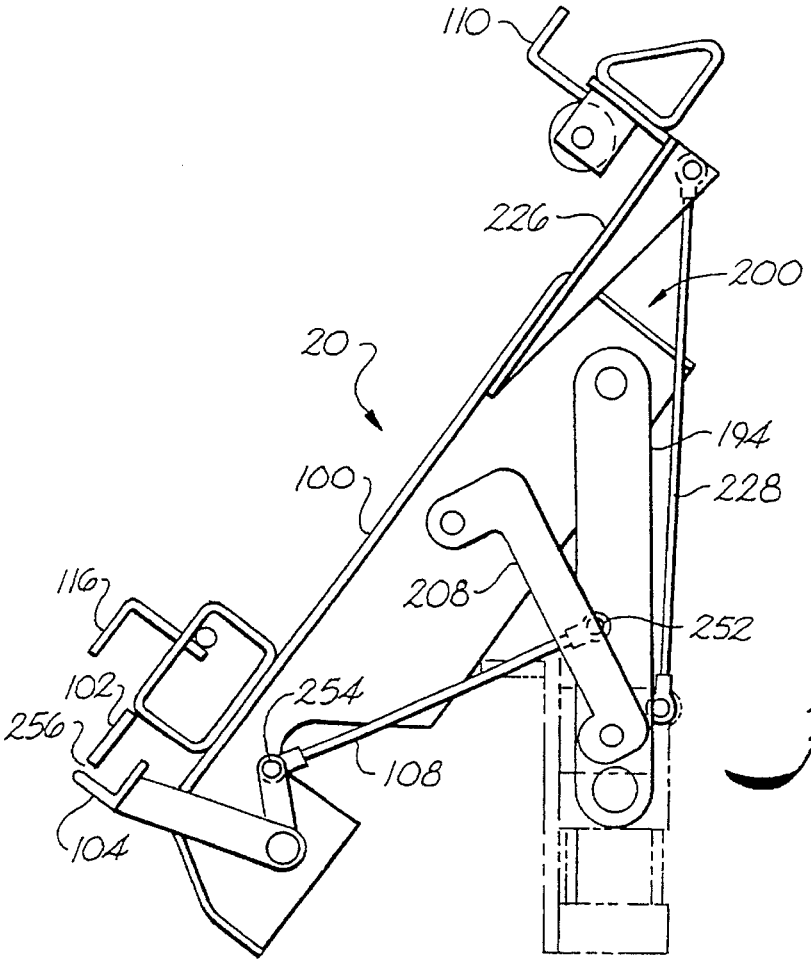

It will be further noted by those of ordinary skill in the art from the present illustrations that a gap generally 256 (FIG. 12E) remains between clamping elements 102 and 104 after face plate 100 is raised into its fully raised inverted position. Such an arrangement prevents overclamping or crushing of the lip 52 of a container 50, so as to prevent undesired damage thereto. At the same time, FIG. 12E represents that such gap 256 (which is adequate for clamping of the container 50) is actually achieved earlier in the dumping cycle so that container 50 is properly engaged (i.e., secured) to lift plate 100 in accordance with the subject invention.

Figure 13:
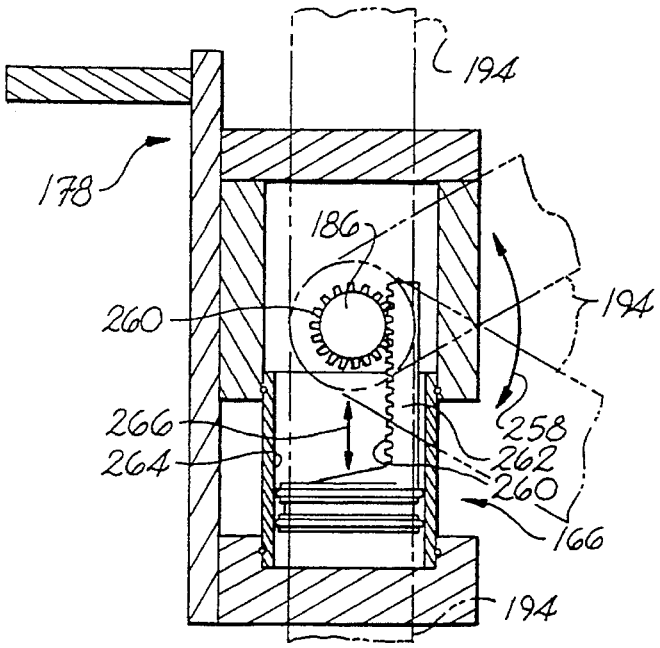
FIG. 13 is an enlarged partial cross-sectional view representative of certain present drive means features.

Present FIG. 13 is an enlarged partially cross-sectional view representative of certain present features of exemplary drive means 166. As illustrated, such drive means generally 166 are supported on a support frame generally 178 and rotatably power a torque arm 194 through different positions thereof as represented by dotted line illustrations 194 and double-headed arrow 258. See also the complete description and disclosure set forth in U.S. Pat. No. 4,773,812 (fully incorporated herein by reference).

Such exemplary drive means 166 may comprise a hydraulically actuated rotary motor, with an output shaft 186 thereof positioned substantially perpendicular to the plane of movement of carriage 100. Such rotary motor includes rack and pinion gear teeth 260 respectively supported on a reciprocal piston rod 262 and on a rotatable portion of the output shaft 186 passing through the rotary motor. Preferably, such rack and pinion gear teeth engage one another immersed in hydraulic fluid within a cylinder 264 of the rotary motor. As will be apparent to those of ordinary skill in the art, such piston rod 262 reciprocates along an axis in the direction of double-headed arrow 266 in response to the selected introduction of hydraulic fluid passing against the piston head or against the bottom thereof, which translates rotary motion of output shaft 186 into desired movement of face plate 100 (via torque arms 192 and 194). Other drive means may be practiced.

The following discussion relates to FIGS. 16A through 19, and outlines certain hydraulic drive circuit features in accordance with this invention. Hose interconnections such as "VA" and "VB" are shown in correspondence on several of the different drawings, as will be understood by those of ordinary skill in the art.

Figure 17:
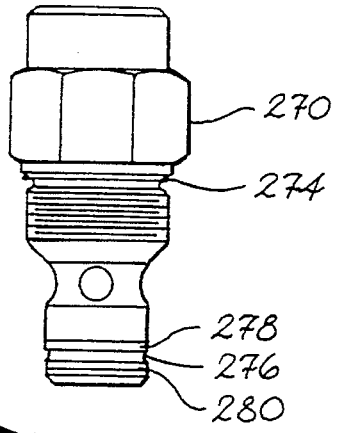
FIGS. 17 and 18 are respective views of two different exemplary adjustment features of the sequencing means in accordance with the exemplary embodiment of present FIGS. 16A and 16B.
Figure 16A:
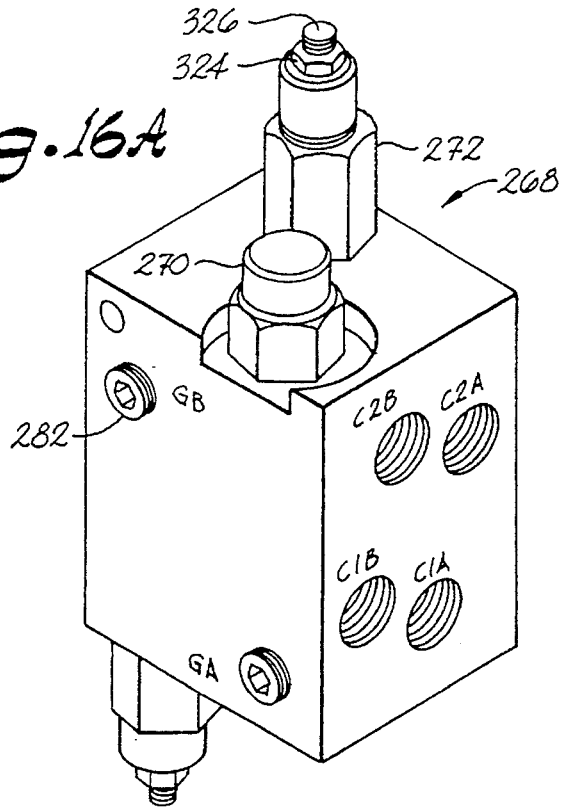
FIGS. 16A and 16B are respective generally side perspective views showing opposite sides of exemplary sequencing means or cycle control means in accordance with the subject invention.
Figure 18:
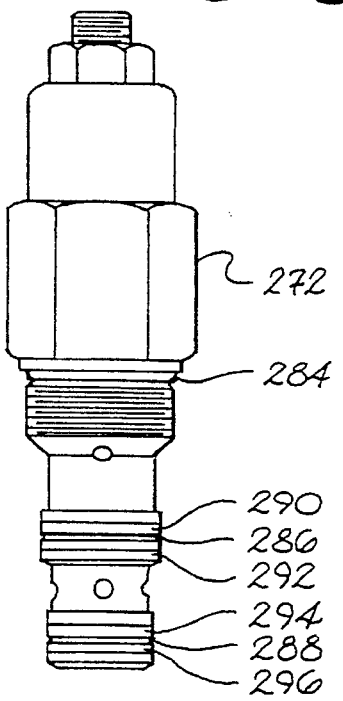
Figure 16B:
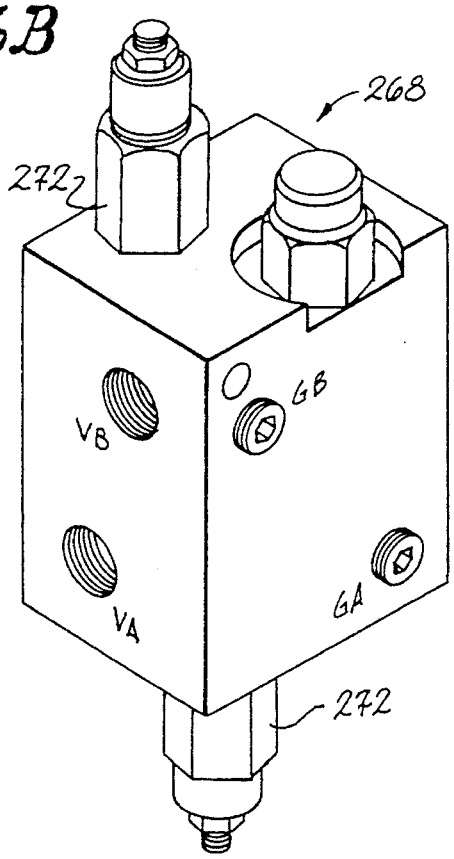
Figure 19:
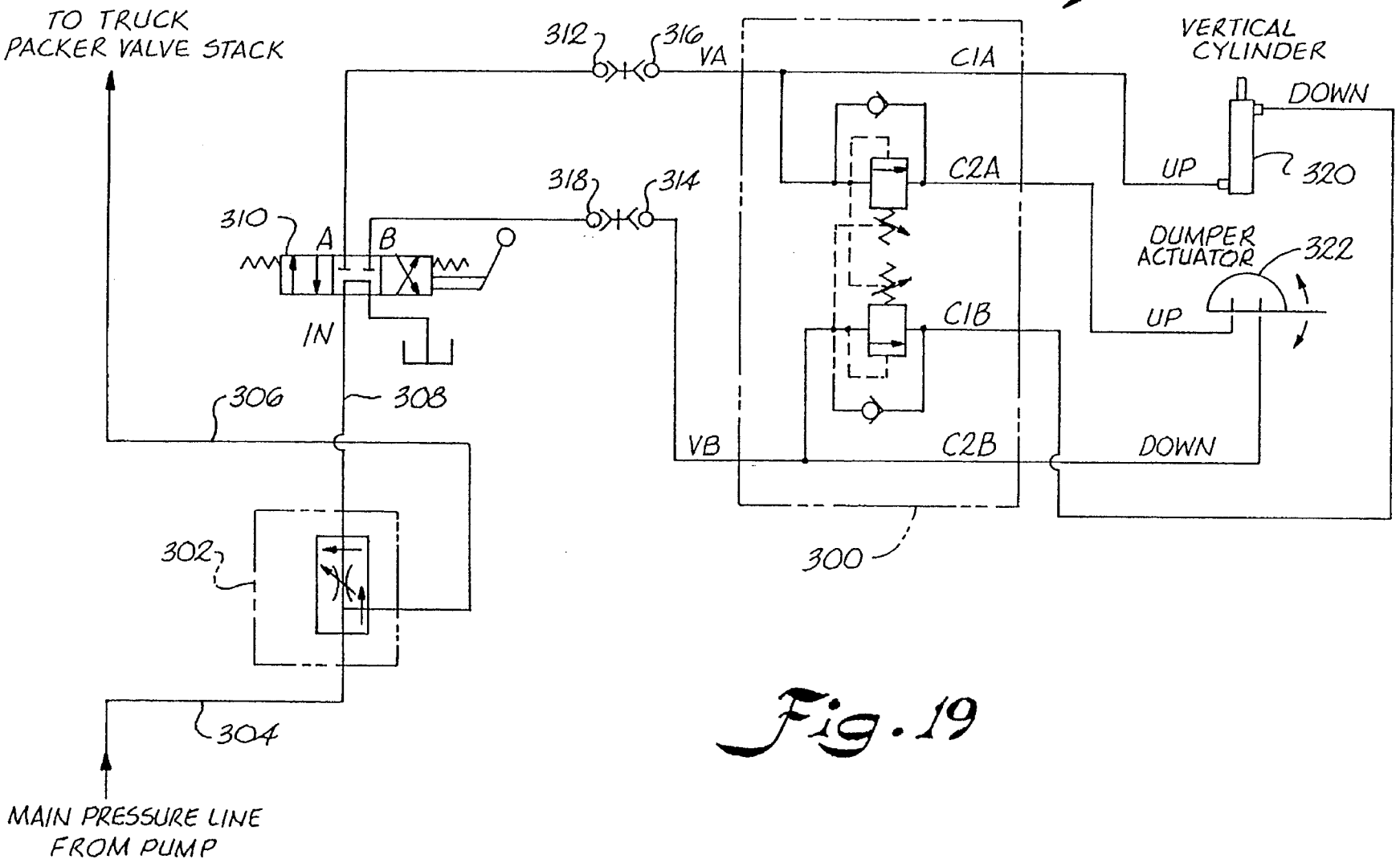
FIG. 19 is a schematic representation of an exemplary hydraulic circuit in accordance with the subject invention, including incorporation therein of present optional vertical lift assembly features.

Generally speaking, FIGS. 16A and 16B are respective generally side perspective views showing opposite sides of exemplary sequencing means 268 (dual sequencing valve) or cycle control means in accordance with the subject invention. FIGS. 17 and 18 are respective views of two different exemplary adjustment cartridges 270 and 272 for the sequencing means in accordance with the exemplary embodiment of present FIGS. 16A and 16B. FIG. 19 is an overall schematic representation of an exemplary hydraulic drive circuit in accordance with the subject invention, including incorporation therein of present optional vertical lift assembly features.

More specifically, the dual sequence valve generally 268 is of a construction as explained in greater detail hereinafter, and is an available component from Fluid Controls Incorporated of Easley, S.C.

Element 270 comprises a check valve cartridge which is outfitted with an O-ring seal 274, and a further O-ring seal 276 which is adjacent to a pair of back-up washers 278 and 280.

Element 282 associated with sequencing means 268 is a form of an exemplary pipe plug for inputs not otherwise utilized with hydraulic lines as discussed hereinafter.

Element 272 comprises a sequence valve cartridge which also includes O-ring seals 284, 286, and 288. The relatively lower O-ring seals include back-up washers 290, 292, 294, and 296.

Referring now to present FIG. 19, a complete schematic representation of a hydraulic drive circuit generally 298 is illustrated. The dotted line enclosure 300 generally equates to the dual sequence valve 268, noted above. The dotted line enclosure 302 is representative of a complete diverter valve, which is well understood to those of ordinary skill in the art. As illustrated, such diverter valve is arranged for receiving main pressurized hydraulic fluid through a main pressure line 304 from a hydraulic pump or similar source. When appropriately set, diverter valve 302 can cause the pressurized hydraulic fluid to be directed to the packer valve stack of an associated refuse collection truck via hydraulic line 306. In other words, such hydraulic arrangements would be utilized during the dumping of container box 46 of present FIGS. 2A and 3.

On the other hand, diverter valve 302 may be used to direct hydraulic fluid along another hydraulic line 308 whenever it is desired to empty the contents of a cart utilizing the present lifter 20. Schematic element 310 represents the hand valve such as discussed above in conjunction with valve 88 of present FIG. 3. The schematic representations should be fully understandable to those of ordinary skill in the art, without additional detailed description thereof.

Elements 312 and 314 represent quick coupler-female coupler elements while features 316 and 318 represent quick coupler-male nipple coupling elements, as discussed above for example for rapid disconnect of a container box 46 in accordance with the subject invention from refuse collection vehicle 42.

The schematic representation generally 320 of a vertical cylinder corresponds with the vertical hydraulic lifting cylinder 172 discussed above such as in conjunction with present FIGS. 4, 10, and 14.

The schematic representation of a dumper actuator generally 322 corresponds with a drive means 166 as generally discussed above with reference to various present figures, including for example present FIGS. 10, 11, 13, and 14.

It will be understood by those of ordinary skill in the art from the present disclosure herewith that the present sequencing valve arrangement allows the vertical cylinder 320 to fully extend and raise a cart before dumping thereof. The sequence valve arrangement also permits the full recovery of the dump cycle (i.e., operation of dumper actuator 322) before the vertical cylinder 320 is retracted for lowering the cart.

It is to be understood that valve and line connection points are made via conventional hydraulic lines between correspondingly indicated reference characters. The following discussion includes reference to such reference characters.

Generally speaking, hydraulic fluid or oil flowing into port VB flows directly through the dual sequencing valve 268 and out port C2B thereof. When pressure on port C2B reaches a certain level, such as approximately 1,000 to 1,500 PSI, the sequencing valve cartridge 272 shifts so as to direct the flow of hydraulic fluid out port C1B. The return of hydraulic fluid from the lifter circuit (i.e., dumper actuator 322) flows through port VA and back to the hydraulic tank.

Hydraulic fluid flowing into port VA flows directly through the dual sequencing valve 268 and out port C1A. When the pressure on such port C1A reaches a predetermined number such as approximately 1,000 to 1,500 PSI, the sequence valve cartridge 270 shifts so as to direct the hydraulic fluid flow out port C2A. The return of hydraulic fluid from the lifter circuit (i.e., from dumper actuator 322) flows through port VB and back to the hydraulic tank.

Operation of the sequence valve cartridge 270 determines or dictates the pressure required at port C1A before the flow of hydraulic fluid is diverted to port C2A. The function of sequence valve cartridge 272 dictates or determines the hydraulic fluid pressure required at port C2B before diversion of the hydraulic fluid flow to port C1B.

Whenever pressurized, port VA functions to permit hydraulic fluid in for vertical extension and actuation of the dumper or lifter. Port VB when pressurized functions so as to permit an inward flow of hydraulic fluid for reversal of the actuator and retraction of vertical lift features. Port C1A when pressurized is functional with respect to vertical extension features, while port C1B is oppositely involved with vertical retraction operations. Ports C2A and C2B are respectively functional when pressurized for actuator (i.e., drive means) dumping and reversing operations, respectively.

As illustrated, both sequence valve cartridges 270 and 272 are preferably fitted with hexagonal drives or similar exterior features for adjustment thereof. In order to adjust sequence pressure, first a lock nut portion 324 of the top of cartridge 272 should be loosened. Thereafter, the central adjusting screw 326 therein should be turned in a clockwise direction when desired to increase the sequence pressure or in a counterclockwise direction in order to decrease the sequence pressure. Once properly positioned, the adjusting screw jam nut 324 is retightened. Ports GA and GB are to be used for hydraulic gauge ports respectively for ports VA and VB, as understood by those of ordinary skill in the art.

It will be further understood by those of ordinary skill in the art of hydraulic drive systems that the initial installation requires appropriate pressure settings so that in effect the dual sequence valve sends pressure to a second or subsequent cylinder or other hydraulic actuator whenever the first cylinder has fully functioned. In other words, the pressure actuation means should be determined and adjusted so that hydraulic drive fluid is directed to dumper actuator 322 after cylinder 320 has bottomed out or completed a full movement in a selected direction thereof. By such an arrangement, cycle control means are provided for first automatically engaging a cart with an engagement member in accordance with the subject invention, and thereafter automatically operating the drive means so as to lift and dump the contents of such engaged cart. As understood by those of ordinary skill in the art, the entire operation is thereafter reversed, for first returning the cart to its upright position and then disengaging therefrom.

With the foregoing features, a totally universal cart lifting apparatus or receptacle dumping apparatus may be provided which automatically matches and mates to the height of the cart to be dumped while also automatically matching and mating to the style of cart to be emptied.

It should be further understood by those of ordinary skill in the art that the foregoing presently preferred embodiments are exemplary only, and that the attendant description thereof is likewise by way of words of example rather than words of limitation, and their use do not preclude inclusion of such modifications, variations, and/or additions to the present invention as would be readily apparent to one of ordinary skill in the art, the scope of the present invention being set forth in the appended claims.

What is claimed is:

1. A lifting apparatus for use with different size residential refuse collection carts, for lifting and dumping the contents thereof into a larger refuse container, said apparatus comprising:

a lift plate for receipt thereon of a refuse collection cart to be emptied;

drive means for controllably moving said lift plate with a refuse collection cart received thereon so as to lift and dump the contents of such cart;

cart engagement means associated with said lift plate for engaging a cart to be emptied for movement thereof with said lift plate;

vertical adjustment means for relatively vertically shifting the position of said lift plate, drive means, and cart engagement means, between an initial null position thereof and a variable raised engaging position thereof at which said cart engagement means is positioned for engaging at least one predetermined lift engagement member on a cart to be emptied; and cycle control means associated with said vertical adjustment means and said drive means for first variably operating said vertical adjustment means so as to engage said cart engagement means with at Least one lift engagement member of a given cart to be emptied, the height of which engagement member is not specifically known, and for automatically thereafter operating said drive means so as to lift and dump the contents of such engaged cart.

2. A lifting apparatus as in claim 1, wherein said cart engagement means comprise cart clamping means associated with said lift plate for clamping thereon a refuse collection cart of the type having a single upper lip to be clamped during lifting of such cart.

3. A lifting apparatus as in claim 2, wherein said cart clamping means includes a lower clamping member relatively fixedly carried on said lift plate for engaging a relatively lower side of a cart single lip as said drive means moves said lift plate for lifting such cart, and further includes an upper clamping member supported in relatively movable relationship to said lift plate for engaging a relatively upper side of the cart single lip; and wherein said lifting apparatus further includes clamp actuation means for closing said relatively movable upper clamping member towards said relatively fixed lower clamping member as said drive means operates so as to clamp the cart single lip for lifting and dumping of such cart.

4. A lifting apparatus as in claim 1, wherein said cart engagement means comprises cart latching means associated with said lift plate for latching thereon a refuse collection cart of the type having a pair of opposing latch engagement surfaces.

5. A lifting apparatus as in claim 4, wherein said cart latching means includes a lower latch member movably mounted between an extended position thereof for engaging the lower of the cart latch engagement surfaces and a retracted position thereof pivoted relatively downward from said extended position thereof, and further includes an upper latch member movably mounted between an extended position thereof for engaging the upper of the cart latch engagement surfaces and a retracted position thereof pivoted relatively upward from said extended position thereof, said lower and upper latch members being biased into said respective extended positions thereof for engagement with and lifting of a cart of the type having a pair of opposing latch surfaces, and further being respectively displaceable therefrom into said respective retracted positions thereof upon contact with a cart of the type having a single upper lip to be clamped for engagement of such cart during lifting and dumping thereof.

6. A lifting apparatus as in claim 5, wherein said cart engagement means further includes cart clamping means associated with said lift plate for clamping thereon a refuse collection cart of the type having a single upper lip to be clamped during lifting of such cart type, so that said cart clamping means are functional for lifting and mounting such cart type with said lower and upper latch members otherwise rotatably retracted by engagement with a smooth side of a cart of the type having a single upper lip to be clamped.

7. A lifting apparatus as in claim 1, further including lift plate extension means operative during operation of said drive means for moving a lift plate extension member between respective retracted and extended positions thereof relative to a lower edge of said lift plate in correspondence with respective lowered and raised positions thereof.

8. A lifting apparatus as in claim 7, further including roller means carried on said lift plate extension member for rotatably engaging a lower side portion of a cart to be dumped as such cart is being raised, for stable lifting of such cart even with a relatively shortened lift plate area whenever said lift plate is lowered and said lift plate extension member is retracted.

9. A lifting apparatus as in claim 1, wherein said cart engagement means comprises an engagement member of predetermined shape for mating with a correspondingly shaped lift pocket on appropriate cart styles.

10. A lifting apparatus as in claim 1, wherein said drive means comprises a hydraulically actuated rotary motor with an output shaft thereof positioned substantially perpendicular to the plane of movement of said lift plate between respective lowered and raised positions thereof, said rotary motor including rack and pinion gear teeth respectively supported on a reciprocal piston rod and on a rotatable portion of said output shaft passing through said rotary motor, and further wherein said rack and pinion teeth engage one another immersed in hydraulic fluid within a cylinder of said rotary motor.

11. A lifting apparatus as in claim 1, wherein:

said vertical adjustment means includes vertical guides with said drive means and lift plate movably supported relative thereto, a support element associated with said vertical guides, and a hydraulic lifting cylinder interconnected between said support element and said drive means and lift plate so that actuation of said hydraulic lifting cylinder moves said drive means and lift plate relative to said vertical guides.

12. A lifting apparatus as in claim 11, wherein:

said drive means comprises a hydraulically actuated rotary motor; and further wherein said cycle control means includes a hydraulic drive circuit for said hydraulically actuated rotary motor and said hydraulic lifting cylinder and including a dual sequencing valve for first applying hydraulic drive power to said hydraulic lifting cylinder so as to lift said drive means and said lift plate until said cart engagement means engages a cart to be lifted, and thereafter automatically diverting hydraulic drive power from said hydraulic lifting cylinder to said hydraulically actuated rotary motor so as to lift and dump the refuse collection cart engaged on said lift plate.

* * * * *